US010539325B2

(12) United States Patent
Moro et al.

(10) Patent No.: US 10,539,325 B2
(45) Date of Patent: Jan. 21, 2020

(54) DEVICE FOR MANAGING GAS APPLIANCES, AND CORRESPONDING SYSTEMS AND METHODS

(71) Applicant: ELTEK S.p.A., Casale Monferrato (Alessandria) (IT)

(72) Inventors: Marco Moro, Casale Monferrato (IT); Paolo Savini, Casale Monferrato (IT)

(73) Assignee: ELTEK S.p.A., Casale Monferrato (Alessandria) (IT)

( * ) Notice: Subject to any disclaimer, the term of this patent is extended or adjusted under 35 U.S.C. 154(b) by 194 days.

(21) Appl. No.: 15/743,097

(22) PCT Filed: Jul. 15, 2016

(86) PCT No.: PCT/IB2016/054237

§ 371 (c)(1),
(2) Date: Jan. 9, 2018

(87) PCT Pub. No.: WO2017/013558

PCT Pub. Date: Jan. 26, 2017

(65) Prior Publication Data

US 2019/0078781 A1 Mar. 14, 2019

(30) Foreign Application Priority Data

Jul. 17, 2015 (IT) ..... 10201535662

(51) Int. Cl.
*F23N 5/20* (2006.01)
*F23N 1/00* (2006.01)
(Continued)

(52) U.S. Cl.
CPC ..... *F23N 5/203* (2013.01); *F23N 1/002* (2013.01); *F24C 3/126* (2013.01); *F24C 7/083* (2013.01);
(Continued)

(58) Field of Classification Search
CPC ..... F24C 7/083; F24C 15/104; F24C 3/126; F24C 7/082; F23N 1/002; F23N 5/203; F23N 2023/38; F23N 2041/08
See application file for complete search history.

(56) References Cited

U.S. PATENT DOCUMENTS

2004/0096790 A1* 5/2004 Querejeta ..... F23D 14/725 431/80
2006/0068348 A1* 3/2006 Blank ..... F23Q 3/00 431/78
(Continued)

FOREIGN PATENT DOCUMENTS

WO WO 2010/134040 11/2010
WO WO 2013/175439 11/2013

OTHER PUBLICATIONS

International Search Report and Written Opinion of the ISA for PCT/IB2016/054237, dated Nov. 30, 2016, 18 pages.

*Primary Examiner* — Alfred Basichas
(74) *Attorney, Agent, or Firm* — Nixon & Vanderhye P.C.

(57) ABSTRACT

A control device for gas appliances comprises a circuit arrangement that includes: —a switching circuit, electrically connected between an electromagnet and a thermoelectric generator of a safety valve of a gas tap; —a control circuit (71), designed at least for counting time and configured for controlling the switching circuit; —a command circuit, connected in signal communication with the control circuit (71) at least for the purposes of setting the aforesaid time interval. The circuit arrangement comprises a power-supply module (50), for low-voltage d.c. supply, and the switching circuit belongs to a control module (40) which is designed to be operatively associated to a respective gas tap. The control circuit belongs to a second control module (60) that comprises a wireless-communication circuit, in particular a transceiver circuit, electrically connected to the control
(Continued)

circuit (71) and configured for exchange of signals in wireless mode with a remote electronic programming device, which can be used at least for manual setting of the aforesaid time interval.

20 Claims, 18 Drawing Sheets

(51) Int. Cl.
*F24C 3/12* (2006.01)
*F24C 15/10* (2006.01)
*F24C 7/08* (2006.01)

(52) U.S. Cl.
CPC ..... *F24C 15/104* (2013.01); *F23N 2023/38* (2013.01); *F23N 2041/08* (2013.01); *F24C 7/082* (2013.01)

(56) References Cited

U.S. PATENT DOCUMENTS

2011/0146649 A1 6/2011 Brenner
2011/0232627 A1* 9/2011 Arizmendi Zurutuza ..... F23N 1/005 126/39 BA
2012/0115096 A1* 5/2012 Gadini ..... F23K 5/007 431/87

* cited by examiner

DEVICE FOR MANAGING GAS APPLIANCES, AND CORRESPONDING SYSTEMS AND METHODS

This application is the U.S. national phase of International Application No. PCT/IB2016/054237 filed 15 Jul. 2016, which designated the U.S. and claims priority to IT Patent Application No. 102015000035662 filed 17 Jul. 2015, the entire contents of each of which are hereby incorporated by reference.

FIELD OF THE INVENTION

The present invention relates in general to devices, systems and methods for managing appliances that have one or more gas burners or similar flame generators. More in particular, the invention regards a control device having a timing function, for example for enabling setting and/or detection of a time interval for supplying gas to a respective burner.

PRIOR ART

Gas taps commonly used in cooking appliances and the like have a body, generally made of metal, provided with an inlet, designed for connection to a gas-supply line, and an outlet, designed for connection to a duct for delivery of the gas to the burner controlled by the tap. Mounted within the tap body are means for regulating the flow rate of gas, consisting, for example, of an open/close element or partializer that can be regulated in position via a manoeuvring rod. The rod projects axially from a proximal end of the tap body and is designed to turn about its own axis to enable the aforesaid regulation of flow rate. Coupled to the manoeuvring rod is a knob: a rotation imparted manually to the knob hence causes rotation of the rod and consequent regulation of flow rate. Provided within the tap body is a safety valve, which can be kept in the respective open condition by a electromagnet, the valve being of an open/closed type, for enabling or preventing, respectively, flow of gas to the burner. The electromagnet is supplied via a thermoelectric generator, typically constituted by a thermocouple connected to a corresponding electrical connector of the tap body. The opposite end of the thermocouple, i.e., its sensitive part or hot junction, is installed in the proximity of the burner controlled by the tap. When the burner is lit, the sensitive part of the thermocouple generates an electromotive force (e.m.f.) in response to the heat generated by the flame to the burner, which determines a current that supplies the electromagnet of the safety valve such as to keep the open/close element of the latter (associated to a movable core attracted by the electromagnet) in the respective open condition, countering the action of a spring.

Basically, as long as the burner is lit the thermocouple generates a current that enables the electromagnet to keep the valve open. When the burner is turned off manually, or turns off accidentally, electrical supply to the electromagnet ceases, and the valve closes, urged in this direction by the aforesaid spring, so as to prevent passage of gas between the inlet and the outlet of the tap. For the above reasons, the rod of the tap is able to translate along its own axis, in a driving direction, against the action of elastic means inside the tap body. This axial displacement can be obtained by pushing the knob of the tap and turning it. With this movement there is determined both an initial opening of the safety valve and flow of gas to the burner, and the knob is kept in the depressed condition until the burner is lit. As has been said, in the presence of the flame, the thermocouple generates the current that, via the electromagnet, keeps the valve in the open condition. After lighting the gas, the user can hence release the knob.

To a gas tap of the type referred to previously there may be associated a device for timed control of the supply of gas to a corresponding burner, i.e., for enabling setting of a desired time interval of operation of the burner.

Timer devices are known, which are configured for being mechanically and electrically coupled to a respective gas tap and have a corresponding knob, substantially coaxial to the knob of the tap. Via the knob of the device a user can set a desired time interval of supply and then light the burner. Upon expiry of the time interval set, the device causes closing of the safety valve inside the tap so as to interrupt supply of gas to the burner. For this purpose, the device integrates a control circuit arrangement that basically includes timer means, which can be set via the corresponding knob, and controllable electrical switching means, connected between the thermocouple and the electromagnet of the safety valve of the gas tap. A device of this type is known, for example, from WO 2010/134040 A.

These devices are in general relatively complex to produce and assemble, in view of the fact that the entire set of circuit components of the device must be housed in a casing that is directly mechanically coupled to a corresponding gas tap of the appliance, with the casing that must also have associated the knob for manual setting of the desired time for supply of the burner, as well as a corresponding sensor (for example, a potentiometric sensor) for detecting operation of the knob. This casing is hence also relatively cumbersome, which complicates installation thereof within the structure of the appliance, in particular when to a number of taps there must be associated respective timer devices.

The above problems are partially solved by the control device described in WO 2013/175439 A, based on which is the preamble of claim 1. In this solution, the control circuitry of the device is supplied at low voltage and comprises a plurality of control modules, each of which can be coupled to a corresponding gas tap. The device then includes a common auxiliary module, which is housed within the gas appliance in a position remote from the control modules and connected to the latter via wiring for carrying the electrical supply and low-voltage control signals. Housed in the auxiliary module is the circuitry necessary for execution of various functions, such as the function of low-voltage supply, the function for control of power of a circuit for lighting the burners, a function of acoustic warning, and a function of detection of the presence of a flame on the controlled burner or burners.

This solution enables reduction of the dimensions and circuit complexity of the modules to be associated to the individual taps, which are, however, still relatively inconvenient to install within the gas appliance. The production of the auxiliary module is then relatively costly.

SUMMARY OF THE INVENTION

In general terms, the present invention proposes providing a control device of the type referred to at the start that has a structure and functions improved as compared to those of the prior art, and in particular a control device that is simple and inexpensive to produce, far from cumbersome, easy to assemble, highly reliable, and convenient to use.

The above and other aim still, which will emerge more clearly hereinafter, are achieved according to the present invention by a control device for gas appliances having the characteristics referred to in the annexed claims, which form an integral part of the technical teaching provided herein in relation to the invention. Also forming a subject of the invention is a gas appliance, a method for managing a control device that equips a gas appliance, and a configuration system for at least one from among a gas appliance, a control device for a gas appliance and a programming device of a control device for a gas appliance.

BRIEF DESCRIPTION OF THE DRAWINGS

Further objects, characteristics, and advantages of the present invention will emerge clearly from the ensuing detailed description and from the annexed drawings, which are provided purely by way of explanatory and non-limiting example and in which.

DESCRIPTION OF PREFERRED EMBODIMENTS OF THE INVENTION

Reference to "an embodiment" or "one embodiment" in the context of the present description is meant to indicate that a particular configuration, structure, or characteristic described in relation to the embodiment is comprised in at least one embodiment. Hence, phrases such as "in an embodiment" or "in one embodiment" and the like that may be present in various points of this description do not necessarily refer to one and the same embodiment. Moreover, particular configurations, and/or structures, and/or characteristics described may be considered individually or in combination in any adequate way in one or more embodiments, even different from the embodiments described hereinafter by way of non-limiting example. The references used in what follows are provided merely for convenience and do not define the sphere of protection or the scope of the embodiments.

Figure 1:
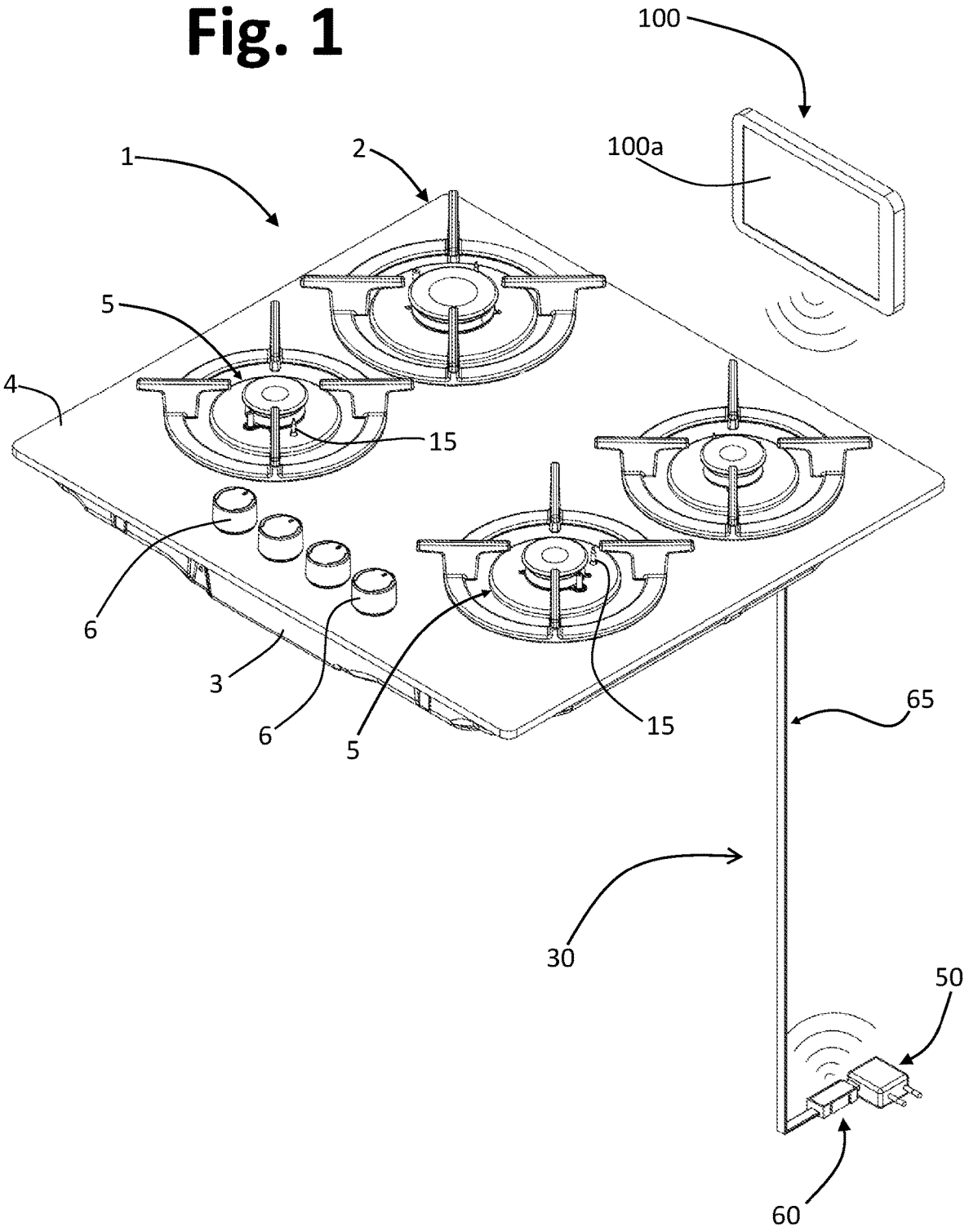
FIG. 1 is a schematic perspective view of a gas appliance provided with a control device according to a possible embodiment of the invention.
Figure 2:
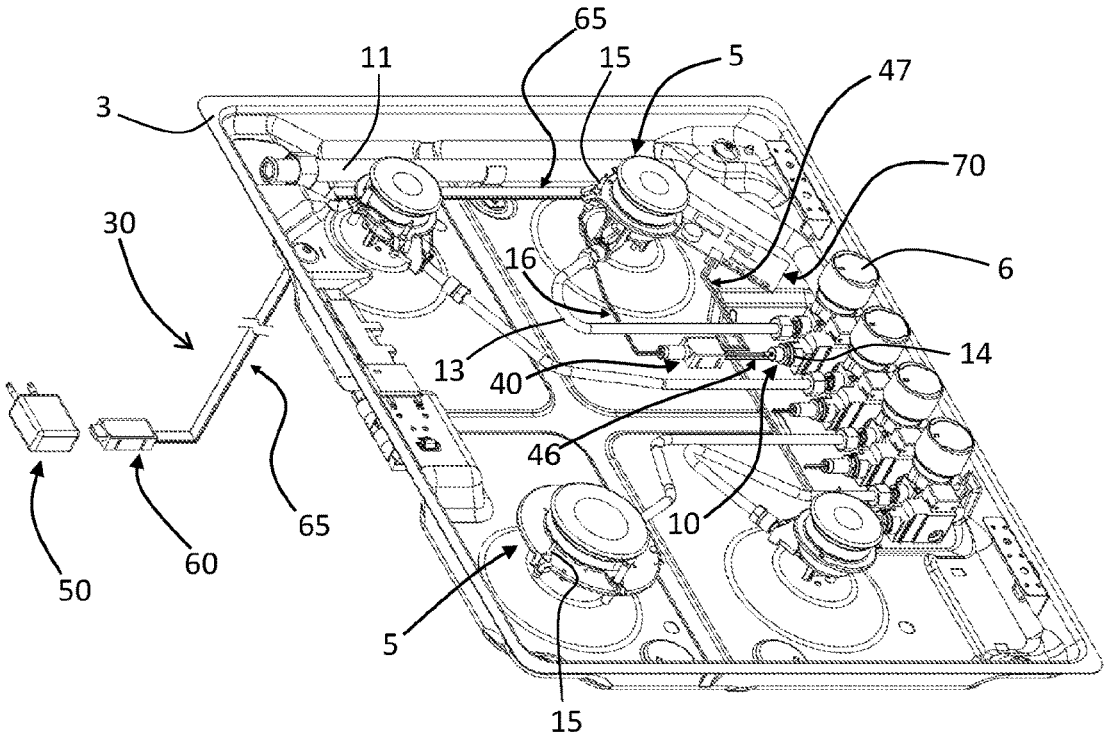
FIG. 2 is a partial and schematic perspective view of a gas appliance provided with a control device according to a possible embodiment of the invention.
Figure 3:
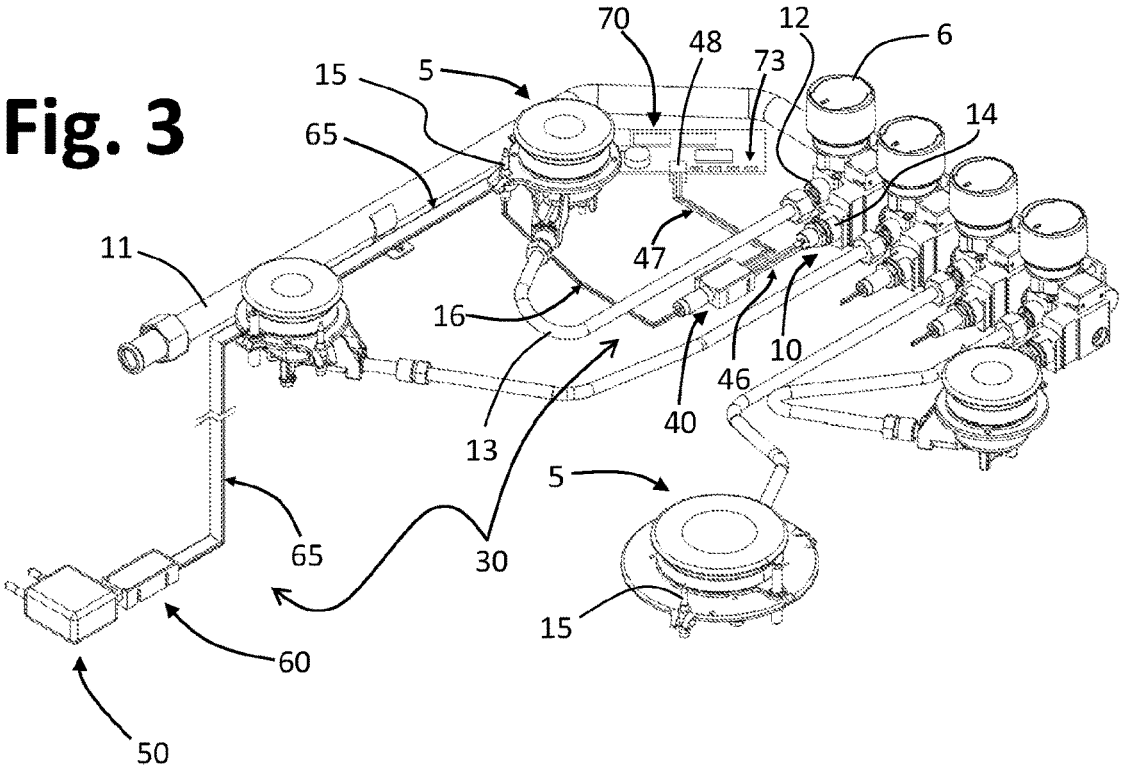
FIG. 3 is a perspective view of some components of the appliance of FIG. 2.
Figure 4:
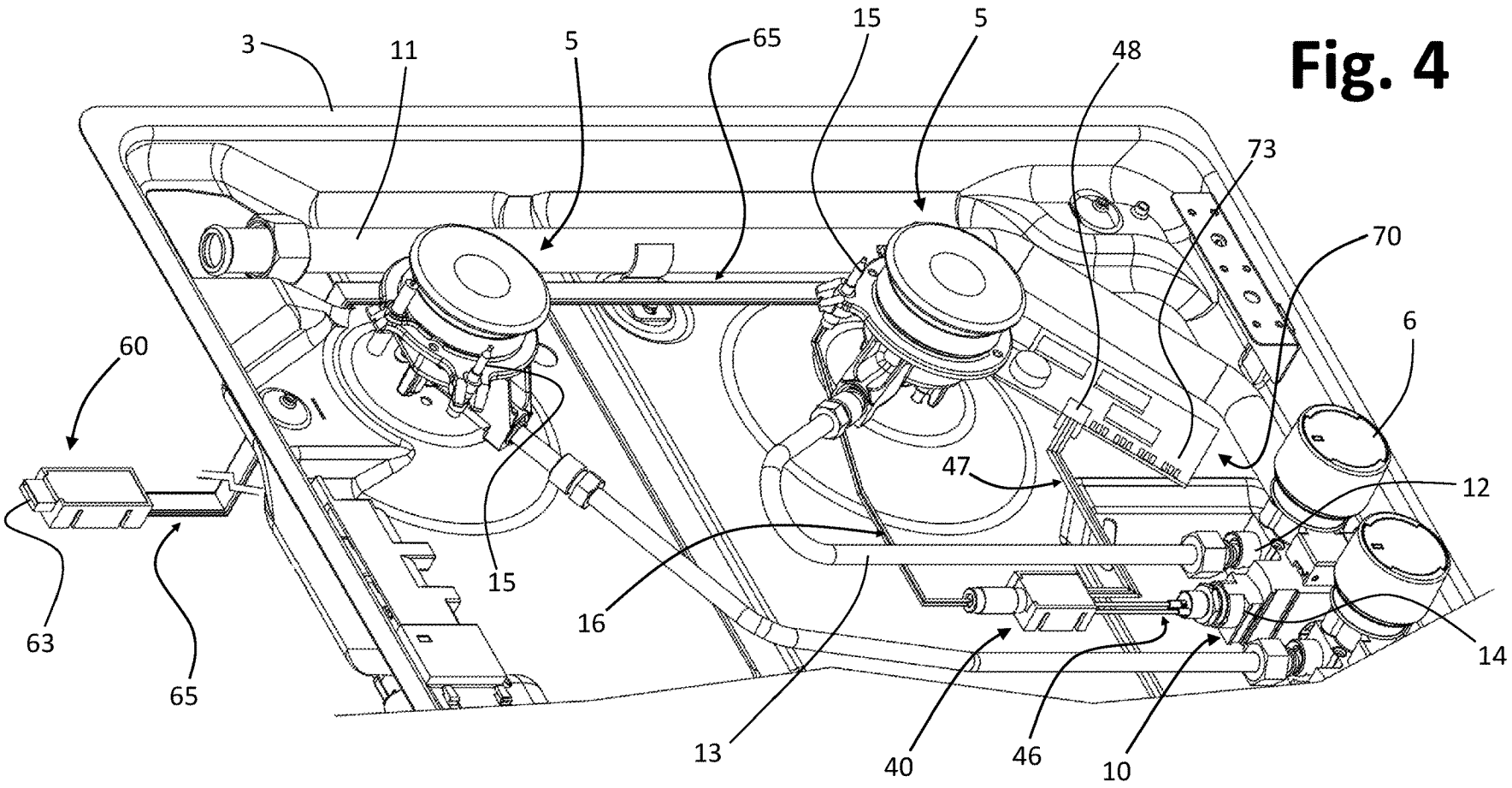
FIG. 4 is a view of a portion of FIG. 2, at an enlarged scale.

Represented schematically in FIG. 1 is a gas-supplied appliance 1, equipped with a control device according to the present invention. In the example illustrated, the appliance 1 is a cooking appliance and, more in particular, a cooking hob, of a general conception in itself known, of which just the elements useful for an understanding of the invention are represented. The control device according to the invention, which is only partially visible in FIG. 1 and is designated as a whole by 30, may in any case also be used in other types of apparatuses provided with at least one gas burner, or similar flame generator, controlled via a respective tap, such as, for example, gas ovens, gas cookers, or boilers, in particular for domestic heating.

The appliance 1 has a housing structure or body 2, which, in the non-limiting example illustrated, includes a bottom box or bottom casing 3, which typically operates as supporting structure for various functional components of the cooking appliance 1 and is fixed to an upper lid 4, defining a work area in which various cooking positions are identified, each comprising a gas burner 5, as well as a control-knob area, provided in which are knobs 6 for controlling respective gas taps, here not visible. As per a known technique, mounted within the structure of the appliance 1 are various functional components, amongst which—for what is here of interest—the aforesaid taps for controlling supply of gas to the burners 5. For this purpose, a wall of the lid 4 has a series of through openings, projecting from each of which is the rod for governing the tap of a corresponding burner. With reference to FIGS. 2-5, the taps—one of which is designated by 10—are fixed inside the housing structure 2 of the appliance 1, in positions corresponding to the aforesaid openings, all according to known technique. Purely by way of example, in the embodiment represented, just one of the taps 10 is equipped with a control device according to an embodiment of the invention.

The taps 10 are of a type in itself known, in particular of the type described in the introductory part of the present description. In various embodiments, projecting—here upwards—from the body of the tap 10 is a corresponding control rod, here not visible in so far as it is engaged by the corresponding knob 6. The body of the tap 10 defines an inlet for the gas (not shown), coming from a supply duct, designated by 11, and an outlet for the gas, designated by 12 in FIGS. 3 and 4. Connected to said outlet 12 is a tube 13 for delivery of the gas to the corresponding burner 5. The body of the tap 10 moreover defines an attachment or connector, designated by 14, substantially corresponding to the electrical connector of the electromagnet or solenoid of a safety solenoid valve, as explained in the introductory part. In traditional applications of the tap 10, i.e., when there is not provided a control device of the type considered herein, connected to the connector 14 of the tap is the electrical connector of a thermocouple or similar thermoelectric generator, having a sensitive part 15 set in the proximity of the flame spreader of a corresponding burner 5. As already explained in the introductory part of the present description, this thermocouple is used for keeping the safety solenoid valve of the gas tap 10 in the open condition. As will be seen hereinafter, in various embodiments of the invention, the conductors of the thermocouple 15, designated as a whole by 16 in FIGS. 2-5, are designed for connection with a first functional module, in particular a control module, belonging to the device 30, which is in turn connected to the connector 14, where the control module includes a circuit designed to modify the state of an electrical connection between the thermocouple 15 and the aforesaid safety valve. In preferred embodiments, this circuit is configured for interrupting the electrical connection between the thermocouple and the safety valve via switching means. In possible variant embodiments, this circuit may, instead, be prearranged for modifying the state of the aforesaid connection, without necessarily interrupting it, but simply by varying it, for example by inserting in parallel or in series to the thermocouple a load or a resistance that reduces the current to the solenoid of the safety valve. In what follows, for brevity, the circuit that equips the aforesaid first control module will be defined also as "switching circuit", without prejudice to its function of interrupting the electrical connection between the thermocouple and the safety valve or else of modifying it so as to enable in any case closing of the valve.

Possibly associated to the taps 10 of the appliance 1 may be a respective electrical switch, which may be operated via axial translation of the corresponding knob 6 and of the associated control rod, for controlling a lighter circuit, having at least one respective electrode in the proximity of the flame spreader of the corresponding burner 5. The presence of such a lighter circuit is not, however, an essential element of the present invention.

In various embodiments, the control device 30 according to the invention is prearranged for performing at least one timing function and, for this purpose, has a circuit arrangement that includes:

- first electrical-connection means and second electrical-connection means, configured for connection to the electromagnet and to the thermocouple 15, respectively, of the safety valve of a tap 10 controlled by the device 30;
- control means, configured for modifying the state of an electrical connection between the first and second electrical-connection means upon expiry of a certain time interval; and
- power-supply means, comprising a power-supply circuit configured for supplying the circuit arrangement with low-voltage direct current;
- wherein the aforesaid control means comprise:
  - a switching circuit, electrically connected between the first and second electrical-connection means;
  - a control circuit, designed for counting the time and configured for controlling the aforesaid switching circuit; and
  - a command circuit, through which the control circuit receives signals for setting the aforesaid time interval.

The first and second electrical-connection means, as well as the switching circuit, belong to a first control module 40, which is to be associated or connected to a respective gas tap 10, such a first module being in particular configured for installation inside the gas appliance. On the other hand, the power-supply means belong to a power-supply module 50, which is designed to be installed in a position remote from the first control module 40, i.e., distinct therefrom. Preferably, the power-supply module 50 comprises respective means for connection to an a.c. mains, in particular a 220-Vac (nom.) mains, but not excluded from the scope of the invention is the case of a power-supply module in which the supply voltage necessary for operation of the device 30 is generated by one or more batteries, or again the case of a power-supply module provided with one or more batteries that can be recharged from the power mains in order to ensure operation of the device itself even in the absence of mains voltage.

The aforesaid command circuit comprises a wireless-communication circuit, in particular a transceiver designed to transmit and/or receive radiofrequency signals, electrically connected to the control circuit and configured for exchange of signals in wireless mode with a remote electronic programming device, which can be used at least for manual setting of the time interval for supplying gas to a burner. In the ensuing description, the aforesaid wireless-communication circuit will be defined, for practical reasons, also as "transceiver", without this, however, limiting it to circuits that integrate both the receiving function and the transmitting function.

Thanks to the above characteristic, the first control module of the device according to the invention does not have to be equipped with a knob of its own or similar means for manual setting of the aforesaid time interval, i.e., of the desired time for supplying the burner controlled by the device 30.

For this purpose, in fact, the aforesaid electronic programming device, designated, for example, by 100 in FIG. 1 is used. The device 100 preferably operates at frequencies comprised between 2.4 GHz and 5 GHz, in particular according to the Bluetooth communication standard and/or the Wi-Fi communication standard, or else according to the IEEE 802.15 and/or the IEEE 802.11 standard.

In various embodiments, the aforesaid electronic programming device 100 is provided at least with a display and a keypad, preferably a display of the capacitive or touch type capable of performing at the same time input and output functions. Preferably, the device 100 is a standard device of a commercially available type, very preferably a portable electronic device provided with display. Appliances of the type referred to, such as, for example, advanced cellphones, or smartphones, palmtop or pocket computers, tablets, PDA (Personal Digital Assistant) apparatuses, notebooks or netbooks and the like, are widely available on the market at contained costs and in general have a capacity of data processing, storage, and connection that are more than adequate for the use proposed herein as devices for controlling at least some functions of an electrical household appliance, for example a cooking appliance, after prior provision of an adequate control software or program that converts the aforesaid commercially available standard device into a programming device 100 according to the invention.

Among other things, portable electronic devices such as smartphones and tablets are today rather widespread, such that the same device that a user employs for personal use for normal communication purposes (telephone, the Internet, emails) can be adapted to be exploited in the domestic context for implementation of the invention, in particular by providing the necessary software. Of course, the device 100, when it is of a standard type, can be marketed already provided with the aforesaid software, in particular in combination with the appliance 1 or the control device 30 (if the latter is marketed separately from the appliance 1). Very advantageously, the software pre-installed or installable on the device 100 may include a user and/or technical assistance manual of the appliance 1 and/or of the device 30 in electronic form.

Thanks to the invention, the first control module 40, i.e., the one to be associated to the gas tap, may be simplified also from the structural standpoint, since it is no longer indispensable for it to be mechanically fixed to the body of a corresponding tap. For instance, the module 40 may be connected between the thermocouple 15-16 and the tap using flexible wiring, provided with appropriate connectors, and hence also at a certain distance from the tap.

In addition to this, the gas tap, in particular its knob, and the structure of the appliance 1 do not require modifications for the positioning of a knob or the like for setting the times, this function now being assigned to the remote electronic device 100. Of course, also the fact that the electronic device 100 communicates in wireless mode with the device 30 considerably simplifies installation of the device itself, reducing the wiring necessary and practically eliminating any moving mechanical parts.

The communication circuit may be advantageously exploited also for transmission of information in wireless mode to the programming device 100, which preferably comprises a display 100*a*.

The above information may be generated by the control circuit and regards, for example, one or more of the following functions: verification of the operating state of a burner that can be controlled by the device 30 (for example, on or off), faulty states of the burner or of the control circuit, enabling of setting of a time interval of supply for a controllable burner, display of the time elapsed from start of lighting of a controlled burner, residual time prior to expiry of a time interval of supply set for a controlled burner, and so forth. The term "controllable" is herein intended to identify a burner for which a timing can be set or for which turning-off by the device according to the invention can be set, whereas the term "controlled" is intended to identify a burner for which a timing has been set by the device according to the invention. As will be seen hereinafter, in fact, in various embodiments, the functions of the device according to the invention are associated only to some of the burners of an appliance 1.

It will thus be appreciated that, according to various embodiments, the control device according to the invention does not entail pre-arrangement and installation of dedicated display or warning devices, which are typical instead of the prior art.

In various embodiments, the aforesaid wireless-communication circuit belongs to a second functional module, in particular a control module, designated by 60 in FIGS. 1-5, designed to be installed in a position remote from at least one of the first control module 40 and the power-supply module 50, i.e., distinct therefrom. Preferably, the second control module 60 is designed to be installed in a position remote from the module 40.

As may be appreciated, in this way, the circuitry of the first control module 40, i.e., the one that must be functionally associated to the tap 10, is further simplified, to the advantage of reduction of its overall dimensions. The solution of providing the communication circuit in a second control module 60 that is distinct and/or in a position remote from the first control module 40 moreover presents the advantage of centralizing the wireless-communication functions in a single functional module—namely, the module 60—instead of having to distribute them among various modules 40 that are each associated to a respective tap.

In various embodiments, the communication circuit of the device 30 according to the invention operates at frequencies comprised between 2.4 GHz and 5 GHz, preferably according to the Bluetooth and/or Wi-Fi communication standard, or else according to the IEEE 802.15 and/or the IEEE 802.11 standard. Advantageously, also the communication circuit may be of a standard or commercially available type, to the advantage of economy of the solution proposed.

In various embodiments, the module that includes the communication circuit, here represented by the module 60, is designed to be positioned outside the housing structure 2 of the appliance 1. In this way, the quality of the communication, i.e., of transmission and/or reception of information, by the communication circuit and its reliability of operation are very high. This positioning in fact prevents the structure 2 of the appliance 1, which is typically made of metal material, from possibly shielding the transmission and/or the reception of the signals and/or prevents the circuit in question from possibly being affected by the high temperatures that are typically set up inside a gas appliance in the course of its operation: these temperatures may alter or damage operation of the electronic components and/or attenuate the radiofrequency signal transmitted and/or received by the communication circuit. Positioning of the communication circuit outside the appliance 1 also prevents the risk of noise of an electromagnetic nature generated within the structure 2 of the appliance 1 (due, for example, to switching of switches) from possibly affecting the quality of transmission/reception of information. Positioning of the communication circuit outside the appliance 1 moreover enables use of less costly electronic components in so far as they are not selected from the ones designed to withstand high temperatures.

In various embodiments, the aforesaid control circuit of the circuit arrangement, i.e., the part that performs at least functions of timing and control of the switching circuit of the first control module 40, belongs to a third functional module, in particular a control module, designated by 70 in FIGS. 2-7, which is preferably distinct and/or designed to be installed in a position remote from at least one from among the first control module 40, the power-supply module 50, and the second control module 60. Hence, advantageously, the functions of timing and driving of the switching circuit (i.e., of a switch thereof) can be centralized in a single functional module—the module 70—instead of having to distribute them among various modules 40 that are each associated to a respective tap. Preferably, the third control module 70 is distinct and/or designed to be installed in a position remote both from the first control module 40 and from the power-supply module 50, as well as from the third control module 60. This further simplifies production of the module 40, also to the advantage of reduction of its dimensions.

In various preferred embodiments, the second control module 60, which integrates the communication circuit, and the third control module 70 are designed to be installed in a position remote from one another and are connected together in a wired way. This characteristic enables further simplification of production of the control module 40, or of each control module 40, as well as production of the other modules of the circuit arrangement, which can hence have structures that are compact and that can be located, according to the need, in the areas deemed most convenient inside the appliance (for example, the modules 40 and 70) or outside the appliance (for example, the modules 50 and 60). The wired connection between the control modules 60 and 70 is reliable and safe, as regards transport of electrical signals, for example enabling a communication of a serial type between these modules, preferably based upon the RS232 standard.

The fact that, in various embodiments, the module 60 is located in a position remote both from the module 40 and from the module 70, preferably outside the structure of the appliance 1, also prevents these modules 40 and 70 from possibly generating electromagnetic noise that may have an adverse effect on the quality of transmission/reception of information obtained via the module 60.

Splitting of the circuit arrangement into a number of control modules, such as the modules 40, 60 and 70, and a supply module, such as the module 50, also presents the advantage that the latter can be implemented via a power-supply device of a commercially available standard type to the further advantage of simplicity and greater economy of the solution proposed. As has already been mentioned, the power-supply module 50 may be configured for supplying the supply voltage via one or more batteries, also as an alternative to a supply from the power mains. Positioning of the module 50 and/or of the batteries outside the structure of the appliance 1 facilitates replacement of the battery or batteries used and prevents the batteries from possibly deteriorating or having a lower level of performance on account of the high temperatures inside the appliance 1.

In various embodiments, the first control module 40 and the third control module 70 comprise respective interconnection means, for mutual wired electrical connection. In this way, the modules in question may be prearranged separately, mounted in the desired positions, preferably both of them inside the cooking appliance and connected together. For this purpose, preferably, the aforesaid interconnection means comprise fast-coupling connector means. The wired connection between the modules 40 and 70 is reliable and safe as regards transport of the electrical signals necessary for driving the switching circuit of each module 40, as well as of possible other signals, such as signals useful for detection of the presence of a flame near the gas burner controlled by the device according to the invention.

For the same reasons, in various embodiments, the second control module 60 and the third control module 70 comprise respective interconnection means for mutual wired connection, which preferably also comprise fast-coupling connector means. Once again for these reasons, in various embodiments, also the power-supply module 50 and the second control module 60 comprise respective interconnection means for mutual electrical connection, preferably including fast-coupling connectors.

Of course, as has already been mentioned, the control device according to the invention may comprise a plurality of first control modules 40, each electrically connected between the thermocouple and the electromagnet of the safety valve of a respective tap 10 of the appliance 1.

Advantageously, also in embodiments of this type, the first modules 40 can be connected to the third module 70, for the corresponding control, and the third module 70 may be connected to the second module 60 in order to receive from outside the control information necessary for management of timing supply of the burners associated to the taps that can be controlled by the device and, preferably, send to the outside world information on the state of the burners and of the possible timings set.

In various preferred embodiments, the second control module 60 includes a voltage-transformer circuit, for supplying the communication circuit at a voltage lower than that supplied by the power-supply module 50. Advantageously, this solution enables use of power-supply modules that supply at output a nominal voltage of 5 Vdc, for example very widespread commercial power suppliers, suitable for supplying a commercial microprocessor of the control circuit of the third module 70, with the aforesaid voltage-transformer circuit that enables, instead, supply of the communication circuit inside the second module 60, which is also preferably of a commercial type and typically operates at approximately 3 Vdc.

In various embodiments, the circuit arrangement includes a backup battery. In this way, supply of the circuit arrangement is enabled even in the condition of occasional absence of voltage supply from the mains or of failure of the voltage-transformer circuit of the power-supply module. This backup battery may be advantageously housed inside a module which is designed to be positioned outside the housing structure 2 of the appliance 1: in this way, the battery is not subject to the high temperatures that are typically set up inside an appliance provided with gas burners and that may have an adverse effect on operation of the battery itself. The fact that the battery is housed in a module external to the appliance facilitates, if need be, replacement of the battery, without having to gain access to the inside of the structure of the appliance. In various embodiments, the backup battery is housed in the second control module 60, which is preferably set between the power-supply module 50 and the third control module 70, thereby enabling use of a power-supply module 50 of a commercial type and enabling temporary operation of the device 30 even in the event of failure of the power-supply module 50. As mentioned, the backup battery and/or the further batteries could possibly be housed in the power-supply module 50.

In various embodiments, also the power-supply module 50 is designed to be installed outside the structure 2 of the appliance 1, i.e., in an area that is substantially at room temperature. This positioning facilitates replacement of the power-supply module in the event of failure, also in this case preventing any need for gaining access to the inside of the appliance. It should be noted, in this regard, that a power supply of the type considered here is statistically more subject to failure in the course of its service life, given the mean time between failure (MTBF) of corresponding capacitors.

In various embodiments, the circuit arrangement comprises an acoustic-warning circuit, configured for notifying operating states or conditions of the control device according to the invention, this warning circuit preferably belonging to the third control module. In this way, the device can supply to the user acoustic signals, which are preferably differentiated to indicate operating states of the device itself (for example, malfunctioning) and/or to notify different events that involve a gas burner controlled by means of a corresponding first control module 40, such as approach of the end of the time interval set or effective end of the time interval set. Whereas the activity of programming of the time interval can be effectively and intuitively carried out by exploiting a display 100*a* of the remote programming device 100, the availability of acoustic warnings for notifying approach of the end or effective end of the supply time set, for example, for cooking, prevents the user from having to periodically look at the display.

Advantageously, the control circuit, preferably positioned in the module 70, may be prearranged also for sending, via the communication circuit of the module 60, also signals to the programming device 100, which are aimed at producing generation of acoustic warnings or vibrations directly by the device 100. In this way, the user can carry on him the programming device 100 also in a domestic environment different from the one where the appliance 1 (typically a kitchen) is located and be warned in due time as regards the operating states or conditions of the appliance 1 and/or of the control device 30, even without having to look at the display of the programming device 100 periodically. As has been said, advantageously the electronic programming device 100 is a device provided with a touch screen so as to render programming of the desired time for supply of a burner or control of turning-off thereof very simple and intuitive.

In various embodiments, the switching circuit of a first control module, or of each first control module, comprises a switching device, in particular an electronic switch, preferably a MOSFET, and the corresponding control circuit comprises a driving stage of the switching device. In various embodiments, then, the switching device or the switch that constitutes it is housed in the first module 40, whereas the corresponding control stage may be housed in another module, preferably the third module 70.

Preferably, the circuit arrangement also includes a flame-detector circuit—the functions of which are preferably integrated in part in the first module 40 and in part in the third module 70—in order to enable the control circuit to verify effective lighting of a burner controlled by the device forming the subject of the invention. In various embodiments, the control circuit present in the module 70 is prearranged for sending to the programming device 100, via the communication circuit of the module 60, also signals regarding the state detected by the aforesaid flame-detector circuit.

Advantageously, thanks to the presence of the aforesaid flame-detector circuit, on the programming device 100 there may be displayed the current state of a corresponding controllable burner (on or off). In various embodiments, the programming device 100 can monitor the state of a flame-detector circuit, or of each flame-detector circuit provided, detecting any possible anomalous turning-off, without the predefined time set having elapsed. In this case, the state of fault may be displayed on the device 100, for example an anomalous turning-off due to liquid that overflows from a pan placed on the burner.

In various embodiments, moreover, the control circuit of the device 30 is prearranged in a such a way that a time interval of supply of a controllable burner can be set only following upon a prior lighting thereof, basically for safety purposes. The presence of the aforesaid flame-detector circuit is hence advantageous also from this point of view.

Figure 5:
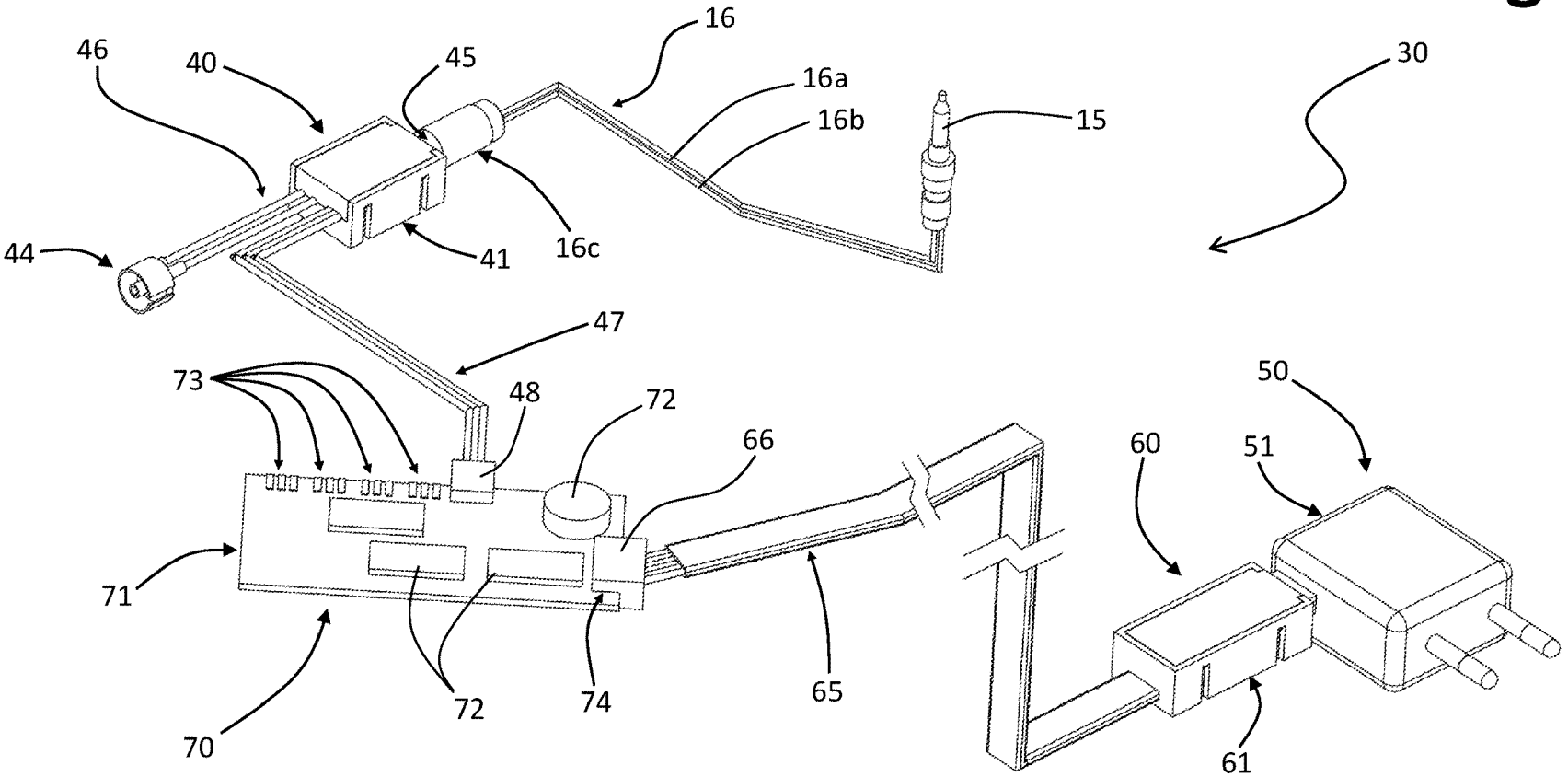
FIG. 5 is a schematic perspective view of a control device according to an embodiment of the invention.

FIG. 5 is a schematic representation of a possible embodiment of the device 30, isolated from a corresponding gas appliance.

In various embodiments, the third control module 70, defined hereinafter for brevity as "main module", has an electronic circuit 71 comprising a printed circuit board (PCB), which is provided with electrically conductive paths and installed on which are electrical and/or electronic control components, some of which are represented schematically and designated by 72. A possible embodiment of the circuit 71, which preferably includes at least one digital control circuit or microcontroller and/or storage means, will be described hereinafter.

The circuit 71 of the module 70 envisages one or more connection elements or connectors, designated by 73, each for wired connection of a respective module 40. In various embodiments, the connectors 73 are of the fast-coupling type, for example male connectors of an edge-connector or card-edge type, i.e., obtained directly from portions of the PCB of the circuit 71 provided with suitable conductive paths, preferably connectors of a Rast 2.5 type. The presence of a plurality of connectors 73 enables, if need be, connection to the circuit 71 of a plurality of modules 40, defined hereinafter for brevity also as "switching modules". Preferably, the circuit 71 includes at least one further connection element or connector 74 (here occupied by a complementary connector 66), for wired connection of the module 60—defined hereinafter for simplicity also as "communication module"—to the main module 70. The connector 74 may be of the same type as the connectors 73, provided with the appropriate number of electrical terminals. In the example of embodiment illustrated in the figures, the main module 70 is without a casing body of its own, which may, however, be provided in other embodiments (not illustrated herein).

Figure 6:
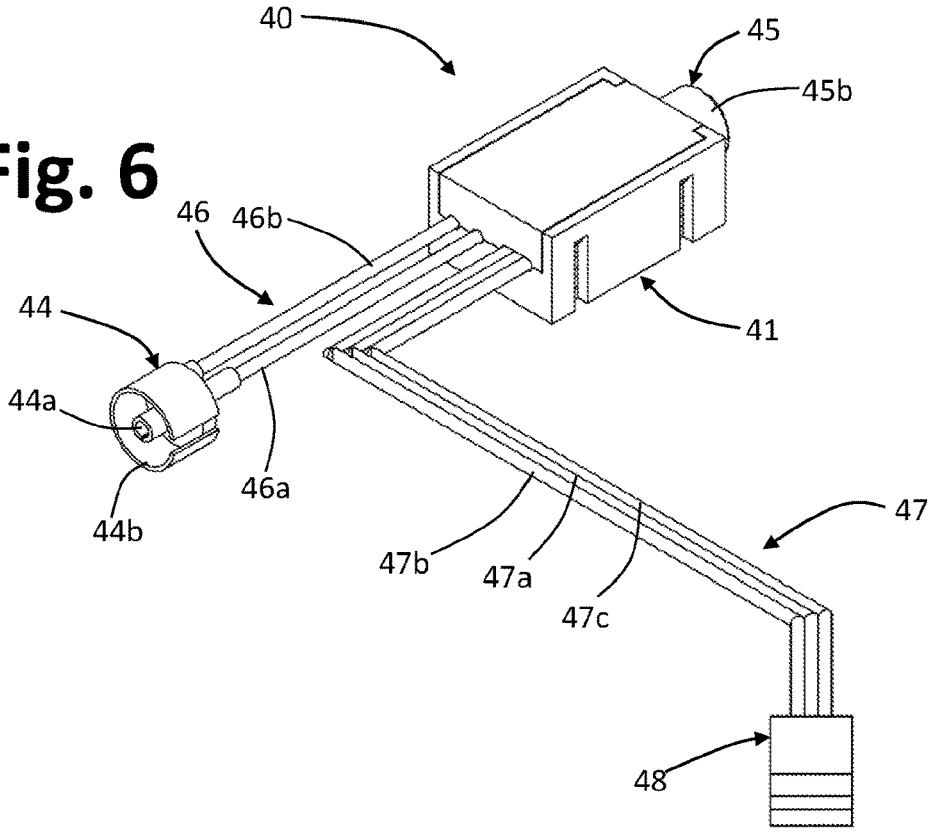
FIGS. 6 and 7 are partial and schematic perspective views of a functional module of a device according to an embodiment of the invention, in FIG. 7 a casing of the module being removed.
Figure 7:
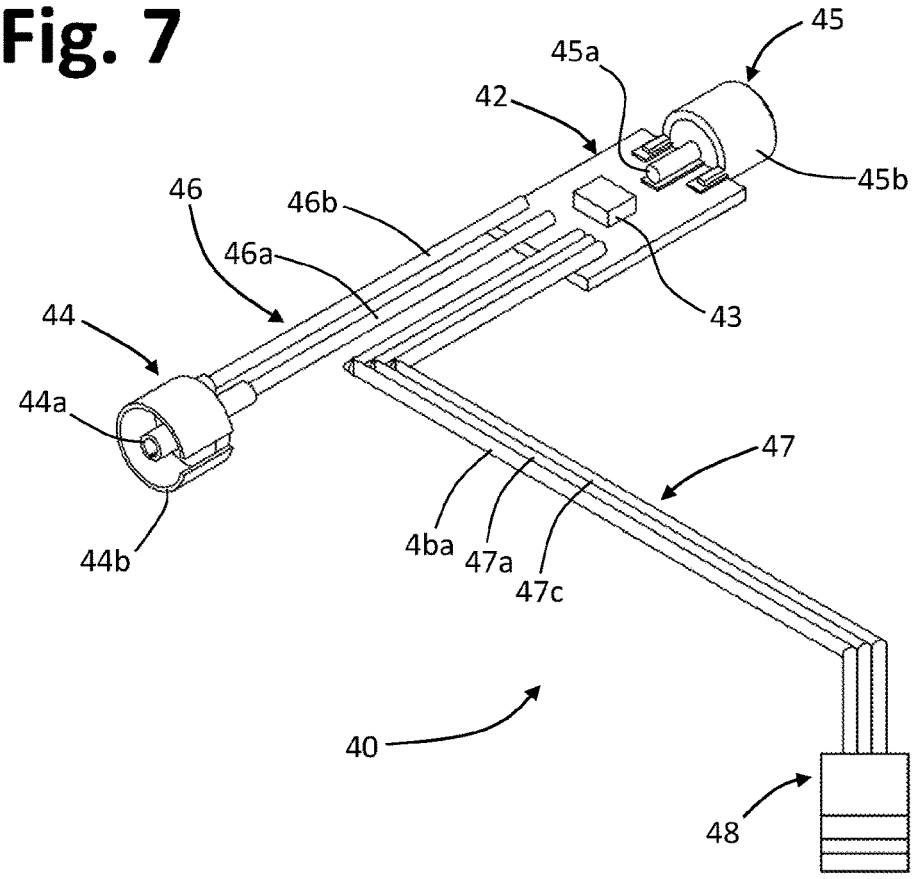

FIGS. 6 and 7 show a possible embodiment of a switching module 40, preferably having a casing body 41 made of electrically insulating plastic material, for example consisting of two parts coupled together, housing the switching circuit mentioned previously. In one embodiment, the aforesaid switching circuit, designated by 42, comprises a PCB, located on which is at least one switching device, such as a switch controllable via low-voltage signals, represented only schematically and designated by 43. In various embodiments, the controllable switch 43 is an electronic switch, in particular a MOSFET.

Preferably, the module 40 includes two connectors, preferably of a complementary type, such as, for example, a male connector 44 and a female connector 45 of a coaxial type or, more in general, male and female connectors of a type commonly used for connection of a thermocouple to the safety valve of a corresponding gas tap. This also enables interposition of the module 40 between a thermocouple and a safety valve which have been previously directly connected together or prearranged for this purpose, it thereby being possible to install the device 30 according to the invention also in appliances that were previously not equipped with such a device.

As may be appreciated, for example from FIG. 5, in fact, the switching module 40 is designed to be electrically connected to the thermocouple 15, the conductors 16*a* and 16*b* of which are connected to a similar male connector 16*c*, which can be coupled to the female connector 45. On the other side, the connector 44 of the module 40 is designed to be coupled to the electrical attachment or connector 14 (see, for example, FIG. 4)—here a female attachment—of the electromagnet or solenoid of the safety solenoid valve of the tap 10 that is being controlled. In the example of embodiment of FIGS. 6-7, the central terminal 45*a* and the peripheral terminal 45*b* of the connector 45 are directly connected to respective conductive paths of the PCB of the circuit 42, whereas the homologous terminals 44*a* and 44*b* are connected to the aforesaid PCB via a wiring 46 with two conductors 46*a* and 46*b*, preferably a flexible wiring, where the ends of said conductors are connected to respective paths of the PCB. According to other embodiments, the connectors 44 and 45 may be of a type different from the one exemplified, for instance both of the fast-on type, or else be different from one another as regards type, for example fast-on on one side and coaxial on the other, or else again be both male or both female, provided that connection of the module 40 between the thermocouple and the solenoid valve is ensured. According to embodiments of the invention not represented, one or both of the connectors 45 and 46 could even be absent. For example, the conductors 16*a* and 16*b* of the thermocouple could be directly connected, for example soldered, to respective paths of the PCB of the circuit 42 and/or the distal ends of the conductors 46*a* and 46*b* could be connected, for example soldered, directly to the solenoid valve of the tap. It will moreover be appreciated that the module 40 does not necessarily have to be mounted on the body of the tap 10, it possibly being positioned at a distance therefrom, as in the case exemplified in the figures.

Moreover associated to the PCB of the circuit 42 is a further wiring 47, preferably with three conductors 47*a*, 47*b* and 447*c*, for electrical connection of the switching module 40 to the main module 70. One end of the conductors 47*a*, 47*b* and 47*c* is soldered or in any case connected to corresponding conductive paths of the PCB of the circuit 42, whereas the opposite ends are connected to the terminals of a connector 48, of a type complementary to a connector 73 of the module 70 (see FIG. 5).

As will be seen hereinafter, in various embodiments the module 40 is used, not only for performing the main function of interrupting or in any case changing the electrical connection between the thermocouple 15-16 and the safety solenoid valve of the tap 10, but also for implementing part of the accessory function of detection of the presence of flame on the corresponding burner 5. In one embodiment, both of the functions are implemented by way of the aforesaid switching device 43, in particular a controllable switch 43, preferably a switch of an electronic type. In such an embodiment, the circuit 71 of the main module 70 includes a purposely provided detector circuit, via which fast interruptions of conduction of the switch 43 are governed via the wiring 47. Interruption of electrical connection between the thermocouple and the safety solenoid valve produces, in the presence of a flame, overvoltages that, via the same wiring 47, can be detected and interpreted by the main module 70. For this purpose, in various embodiments, the conductor 47*a* is used for conveying command signals for the switch 43, the conductor 47*b* is used for conveying voltage signals representing the presence of a flame, and the conductor 47*c* is a ground conductor or common reference conductor (see for reference also FIG. 18, which exemplifies a possible circuit 42 of a module 40).

Figure 8:
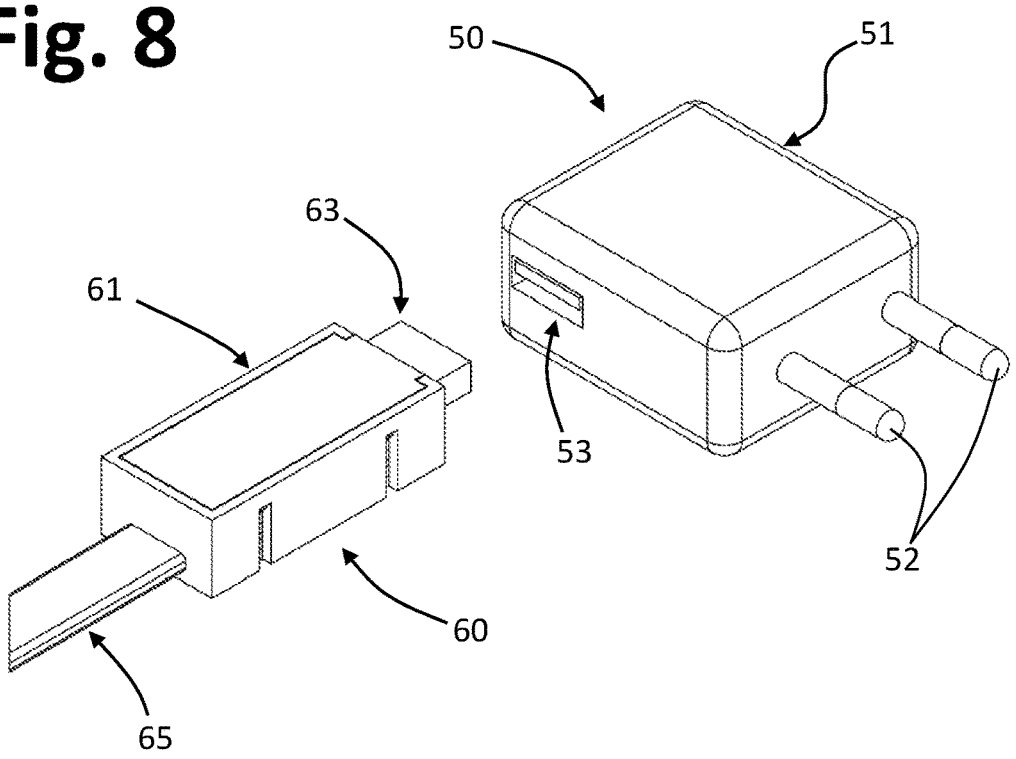
FIGS. 8 and 9 are partial and schematic perspective views of a further functional module and of a supply module of a device according to an embodiment of the invention, in FIG. 9 a casing of the second control module being removed.
Figure 9:
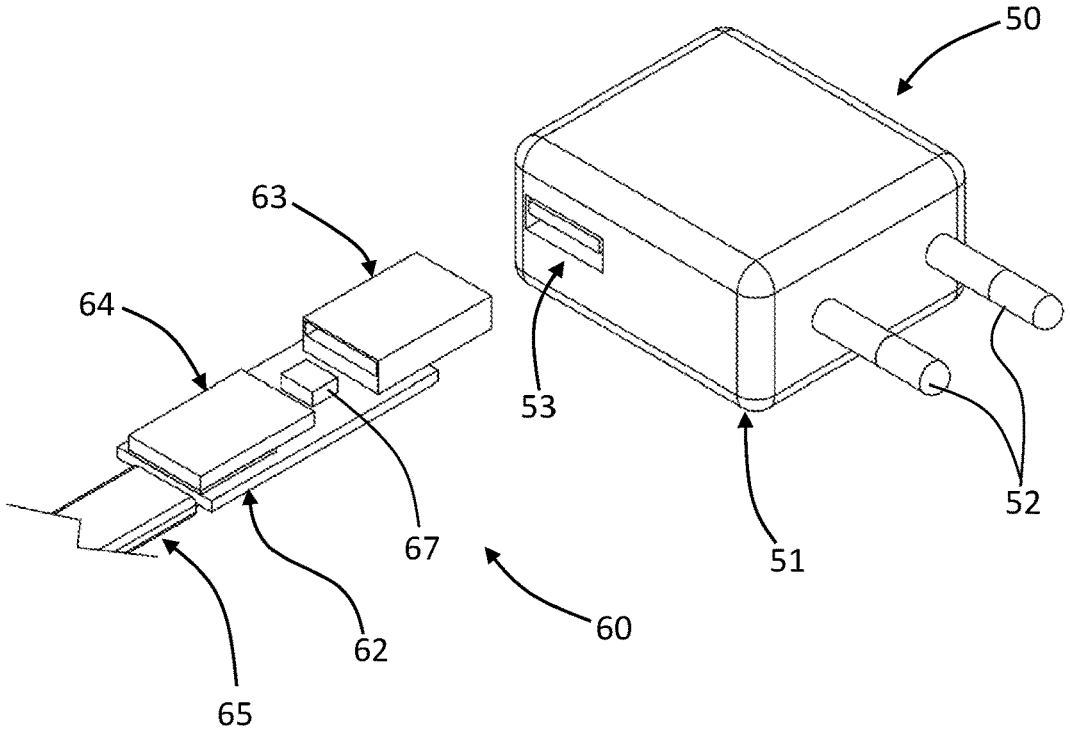

FIGS. 8 and 9 represent possible embodiments of the power-supply module 50 and of the communication module 60.

The power-supply module 50 has a casing 51 of its own, preferably made of electrically insulating plastic material, and is provided with an electrical plug or terminals 52 suitable for connection to a common current or mains socket. Provided within the casing is a supply circuit designed to transform the mains voltage—for example, comprised between 110 Vac and 220 Vac nom.—into a low voltage, for example into 5 Vdc nom., for supply of the control electronics of the device 30. The module 50 preferably comprises a connector or socket for drawing off the transformed voltage, necessary for supply of the modules 60 and 70. In the example illustrated, for this purpose the module 50 is provided with a socket or electrical connector 52 of a USB (Universal Serial Bus) type (including mini-USB or micro-USB), but it is obviously possible to use other types of fast-coupling connectors. A possible circuit diagram of a power-supply module 50 will be described hereinafter with reference to FIG. 14. As has already been mentioned, the power-supply module 50 may advantageously be constituted by a power supply of a commercial type.

Also the communication module 60 has a casing body 61 of its own, preferably made of electrically insulating plastic material, containing a circuit 62 having a PCB, with associated a connector 63 for connection to the power-supply module 50. In the example, the connector, for example a connector of a USB type (including mini-USB or micro-USB), suitable for fast coupling with the connector 53 of the module 50, is directly associated or soldered to the PCB of the circuit 62, and/or associated to or obtained at least in part in the casing 61. In possible variant embodiments, the connector 63 may be obtained from appropriately shaped electrical paths of the PCB 62, or else a suitable wiring may be provided between the connector 63 and the PCB of the circuit 62.

Hence, in various embodiments of the invention, at least part of the control device 30, such as the communication module 60, is provided with a connector of a USB type (including mini-USB or micro-USB), so that it can be connected to a power supply of a commercial type, with evident advantages in terms of reduction of the costs of the device 30.

According to a variant (not represented), the power-supply connection, preferably via connectors of a coaxial or USB type (including mini-USB or micro-USB) could connect the module 50 directly to the module 70, without passing through the module 60. In this case, the module 70 could be provided with an appropriate connector 63 and a voltage regulator 67 and could in turn supply the module 60, which in this case is provided only with the connector 66.

According to an innovative aspect, the modules 50 and 60 are substantially fitted inside one another, by way of the corresponding connectors, i.e., in a position close together and connected by connectors projecting from the respective casings, without any wiring set in between.

Present on the PCB of the circuit 62 is the communication circuit, here exemplified by a transceiver circuit designated by 64, capable of receiving and/or transmitting data in wireless mode. In preferred embodiments, the circuit 64 performs both reception functions and transmission functions in regard to the programming device 100.

The circuit 64 may be expressly developed for this purpose. However, it is preferably implemented by a commercially available electronic component or integrated circuit, which very preferably integrates an interface of a serial type. For instance, commercially available components suitable for the application considered herein, in the case of implementation based upon Bluetooth, are those of the AMS00x family, produced by ACKme NEtworks, Los Gatos, Calif., U.S.A. As has already been mentioned, on the other hand, the communication standard used may be of some other type, for example Wi-Fi. The communication protocol is preferably of a serial type, in particular of an RS232 type, with use of just two lines for data reception and data transmission, in particular with a serial connection to the main module 70.

Connected to the PCB of the circuit 62 is a wiring 65 with a number of conductors for connection of the communication module 60 to the main module 70, the end of the wiring 65 opposite to the PCB having a connector 66 of a type complementary to the connector 74 of the module 70 (see FIG. 5). In various embodiments, the wiring 65 has four conductors, two for the positive and negative of the low-voltage d.c. supply, for example 5 Vdc, and two for carrying the transmission and reception signals, preferably referenced with respect to the aforesaid common negative or ground conductor, which are linked to operation of the transceiver circuit 64.

In a possible embodiment, where the component that implements the circuit 64 requires a power supply lower than the one provided at output from the power-supply module 50, on the PCB of the circuit 62 a voltage regulator or reducer 67 may be provided. For instance, a voltage reducer 67 may be prearranged for reducing the 5 Vdc supplied at output from the power-supply module 50 to just approximately 3 Vdc, which are typically used for supplying commercially available components of the type designated herein by 64. Alternatively, according to other embodiments, a voltage reducer may be provided in the main module 70, in which case the wiring 65 would have two additional conductors, for carrying from the module 70 to module 60 the positive and negative of the low voltage—for example 3.3 Vdc—necessary for supply of the transceiver circuit 64. Obviously, the voltage reducer 67 is not necessary, in case of commercially available circuits 64 designed to function at the supply voltage provided by the module 50 (here 5 Vdc).

As will be seen, the main functions performed by the communication module 60 are:

- wireless reception, from the remote programming device 100, of state queries and/or commands regarding the device 30 and/or a burner 5 controlled or controllable by the device 30, and transfer of these queries and commands to the main module 70, preferably in a wired way; and/or
- reception, preferably in a wired way, from the main module 70, of information regarding the state of the device 30 and/or of the burner or burners 5 controlled or controllable by the device 30, such as information regarding times set and/or elapsed, with corresponding wireless transmission to the programming device 100.

Preferably, both of these functions are performed by means of the transceiver circuit 64.

In various embodiments, the remote programming device 100, preferably of a portable type, is constituted by a commercially available standard device, preferably selected from among cellphones, smartphones, palmtop or pocket computers, tablets, PDA apparatuses, notebooks or netbooks and the like, very preferably operating on an Android™, or iOS™, or WIN™ platform. The device 100 is provided with input means and a display. As has been mentioned, in preferred embodiments, the functions of input and display are performed by a touch screen 100*a* of the device 100, which hence functions also as keypad. Not excluded from the scope of the invention is provision of a portable or remote programming device of a dedicated type, but obviously this implies an increase in cost of the solution. The device 100 is used as user interface of the device 30 according to the invention, in particular at least for the purpose of setting operating and/or control parameters, such as timings and/or input of commands for turning-off of controlled or controllable burners. The device 100 is preferably used also for display of the state of one or more burners controlled or controllable by the system and/or of the timings possibly set, of visual and acoustic warnings, of alarms or warnings in general.

Figure 10:
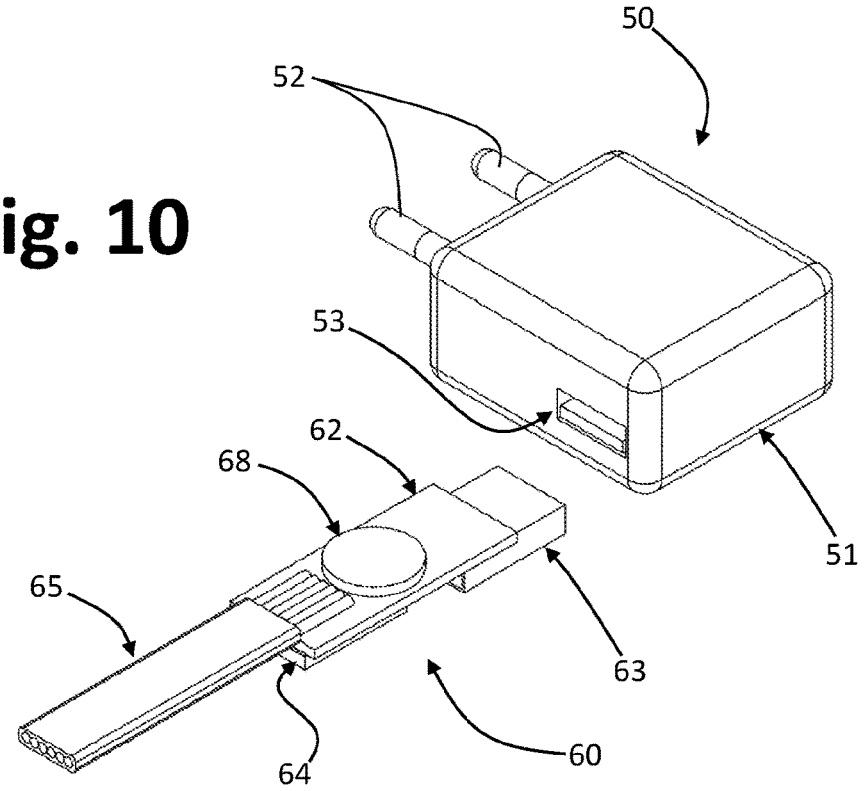
FIG. 10 is a partial and schematic perspective view of a possible variant embodiment of the functional module of FIG. 9.

As mentioned previously, in various embodiments the control device 30 forming the subject of the invention may include at least one backup battery, in order to guarantee operation of the device itself in the case of possible interruptions of the power mains to which the power-supply module 50 is connected, or in the case of failure of the latter. Preferably, the above backup battery is positioned in the communication module 60, the PCB of which will be prearranged for this purpose. An example of embodiment in this sense is provided in FIG. 10, where the reference number 68 designates the aforesaid backup battery, preferably but not necessarily of a button type. As mentioned, the fact that the module 60 is preferably designed to be installed outside the structure of the gas appliance enables easy access to the latter, also for possible replacement of the backup battery 68. For this purpose, the casing body 61 of the communication module 60 is preferably provided with an appropriate removable lid, designed to facilitate access for replacement of the battery.

As has been seen, in preferential versions of the invention, the various modules 40, 50, 60 and 70 are connected together by connector means, preferably of the fast-coupling type. This modularity of the device 30, in addition to being advantageous for the purposes of more appropriate allocation of the various modules, inside and outside the appliance, is convenient also for maintenance purposes. For this reason, according to possible embodiments (not represented), the module 60 is advantageously provided with an electrical connector between the wiring 65 and the PCB of the circuit 62, for example, to enable replacement of the module 60 without having to gain access to the inside of the appliance 1.

It will be appreciated that, in the case of failure of one of the modules, this can be replaced in a simple and fast way, directly by the user in the case of the modules external to the appliance (such as the modules 50 and 60) or else by a person responsible for providing technical assistance, in the case of the internal modules or the modules connected inside the appliance (such as the modules 40, 70, and possibly 60). It will likewise be appreciated that, thanks to the division of the various functions between various modules, also the cost of replacement of the latter is comparatively low, as compared to the case of modules that integrate a number of functions, such as, for example, what is described in WO 2013/175439 as regards the module fixed to the tap, which integrates the majority of the control electronics, and the auxiliary module, which integrates a power supply, a circuit for governing a lighter, an acoustic-warning circuit, and a flame-detector circuit.

In embodiments described previously, electrical coupling between the power-supply module 50 and the communication module 60 is obtained via connectors 53, 63 directly associated to the respective internal circuits and external casings. In this way, as emerges, for example, from FIGS. 1-3 and 5, these two modules are practically coupled together also from a mechanical standpoint, via the connectors 53 and 63, in positions close to one another. At least some of the electrical connectors of the device 30, i.e., of the modules 40, 50, 60, 70, may be provided with means for mutual coupling and/or mechanical fixing, possibly obtained at least in part in the casings of the modules themselves, and/or in the corresponding PCBs.

Figure 11:
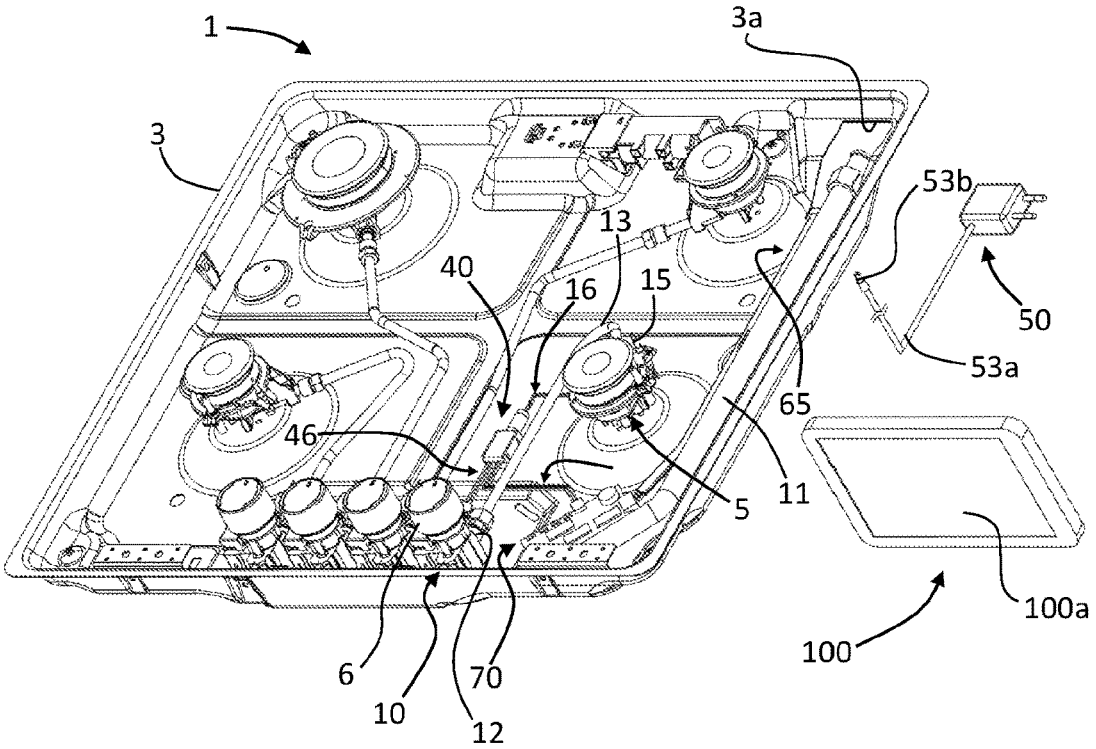
FIGS. 11 and 12 are views similar to those of FIGS. 2 and 3, regarding a gas appliance equipped with a control device according to a variant embodiment of the invention.
Figure 12:
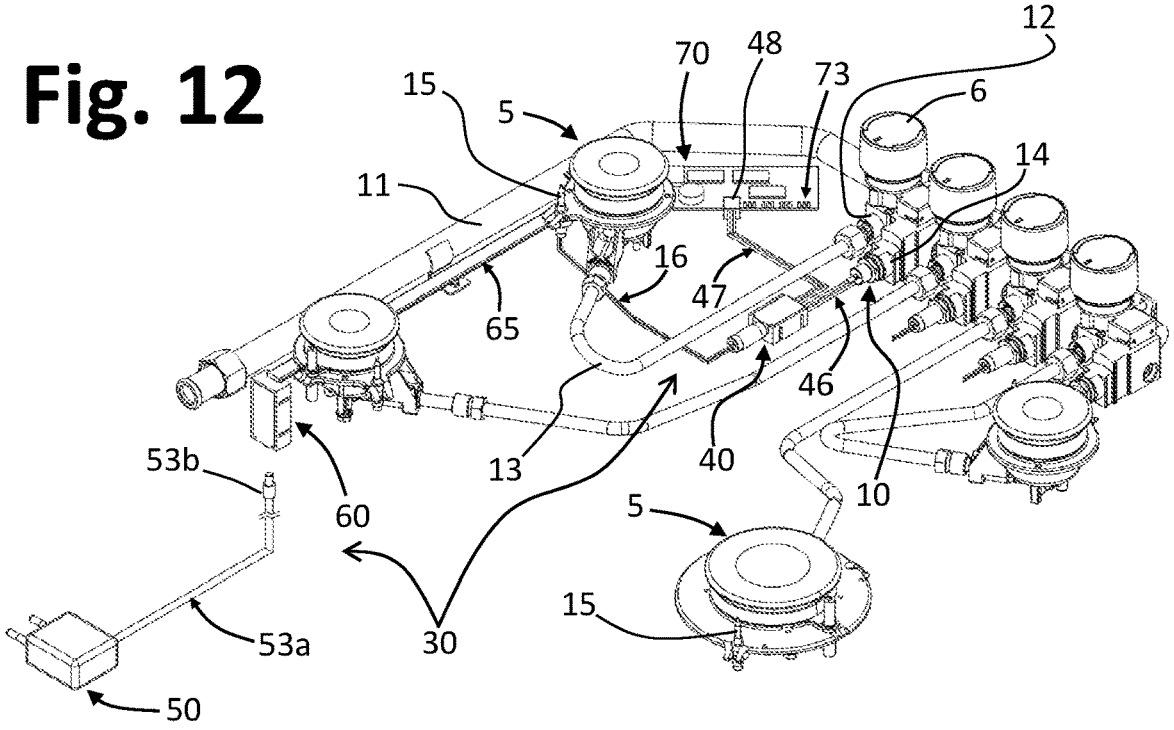
Figure 13:
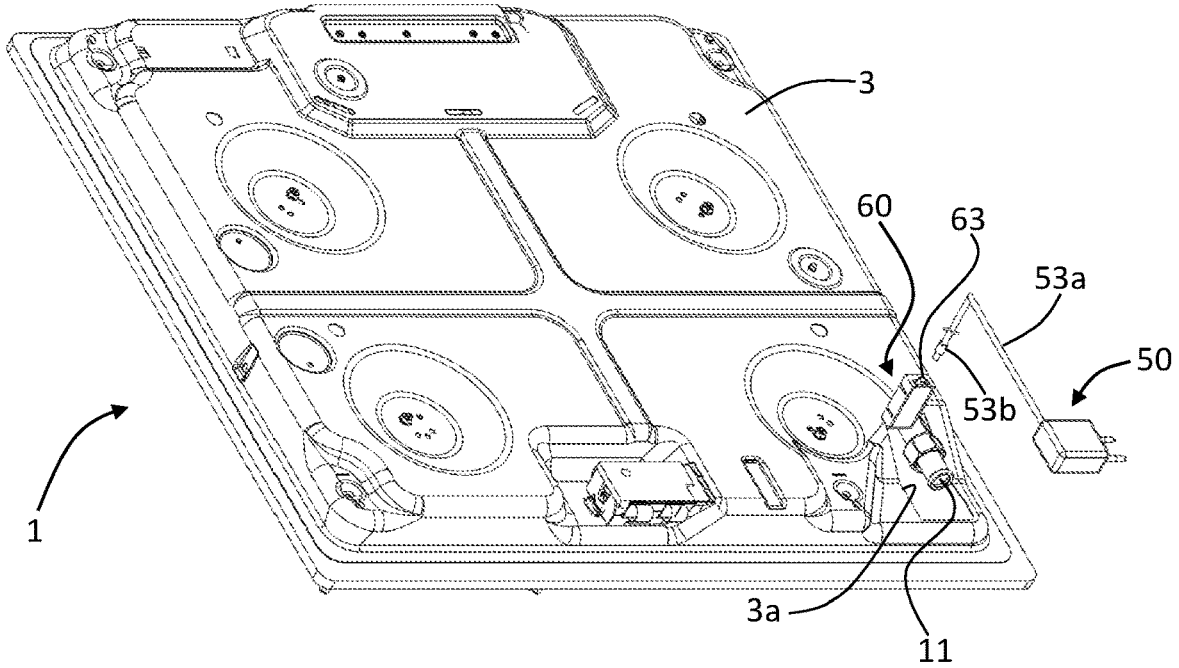
FIG. 13 is a further partial and schematic perspective view of the appliance of FIGS. 11-12.

According to a preferred example represented in FIGS. 1-10, in the assembled condition, the communication module 60 is close to the current socket to which the power-supply module 50 is coupled, generally in a position relatively remote from the appliance 1. In possible variant embodiments, on the other hand, the module 60 may be designed to be installed in a position closer to the structure of the appliance 1, albeit outside the latter, than it is to the power-supply module 50. An example in this sense is illustrated schematically in FIGS. 11-13, where the same reference numbers as those of the previous figures are used to designate elements that are technically equivalent to the ones already described above.

In this embodiment, the wiring 65 has a length shorter than in the embodiments of FIGS. 1-5 so that, in the assembled condition, the communication module 60 is in the proximity of the structure of the appliance 1, outside it. In this case, then, the module 60 is in a position relatively remote from the power-supply module 50 and is located in a generally more protected position, for example inside a kitchen cabinet on which the appliance 1 is installed. For this purpose, the power-supply module 50 has an output cable 53*a*, provided at the end of which is a connector 53*b*, here of a male coaxial type, for connection to a complementary connector 63 of the communication module 60. In the case exemplified, the module 60 is located in the proximity of an opening 3*a* of the bottom box or casing 3, for example the same opening through which the end of the supply duct 11 is accessible towards the outside of the appliance 1, for connection to the external gas-supply grid.

FIGS. 14-18 illustrate schematically possible circuit diagrams of modules 40, 50, 60 and 70 that can be used for implementation of the invention. In these figures, the same reference numbers are used as in the previous figures to designate elements that are technically equivalent to the ones already described previously.

Figure 14:
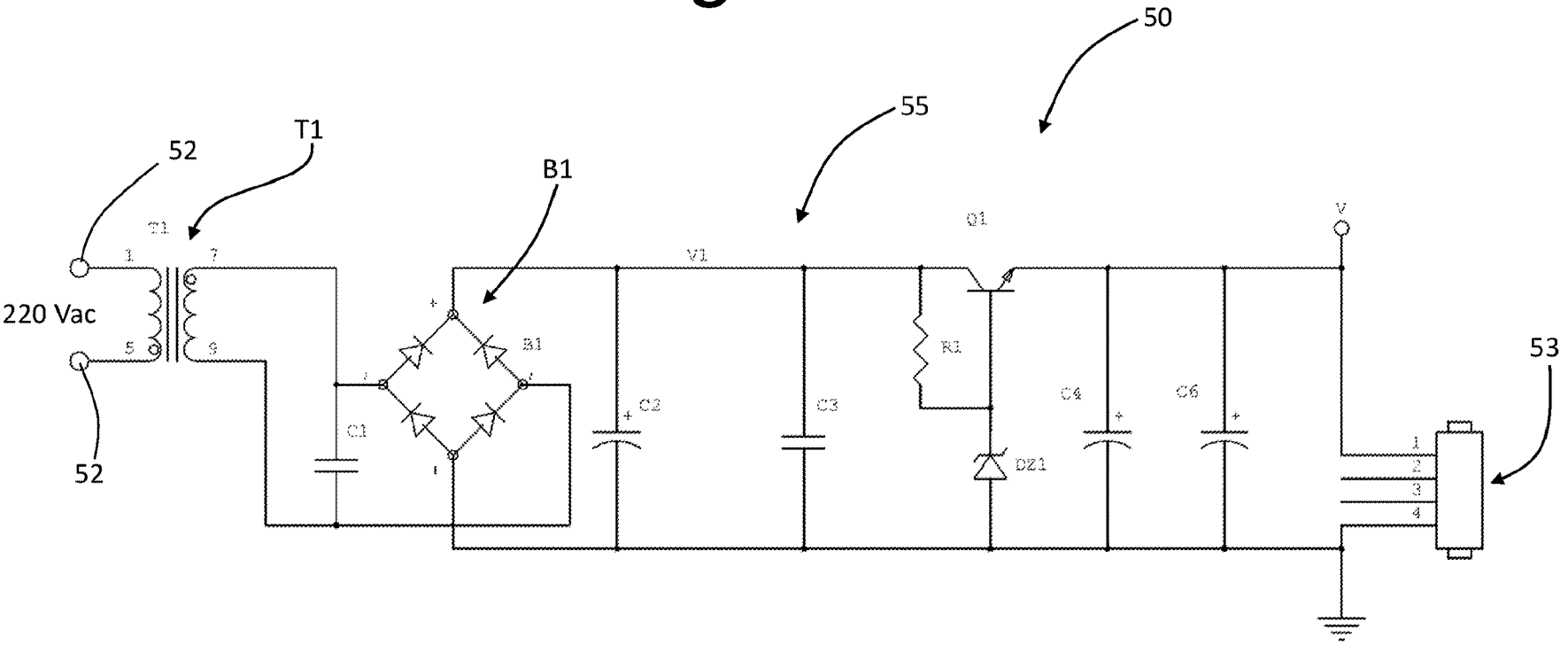
FIG. 14 is a possible circuit diagram of a supply module that can be used in a device according to an embodiment of the invention.

FIG. 14 illustrates a possible supply circuit 55 of a power-supply module 50, which includes a transformer T1, a corresponding rectifier diode bridge B1, passive components (such as capacitors, diodes, resistances) and active components (such as transistors or integrated circuits) designed to provide a stabilised power supply, i.e., a circuit for voltage limitation and stabilisation. As has been said, the module 50 basically has the purpose of generating the semi-regulated d.c. supply voltage, for example 5 Vdc nom., made available on the electrical terminals of a connector 53.

Figure 15:
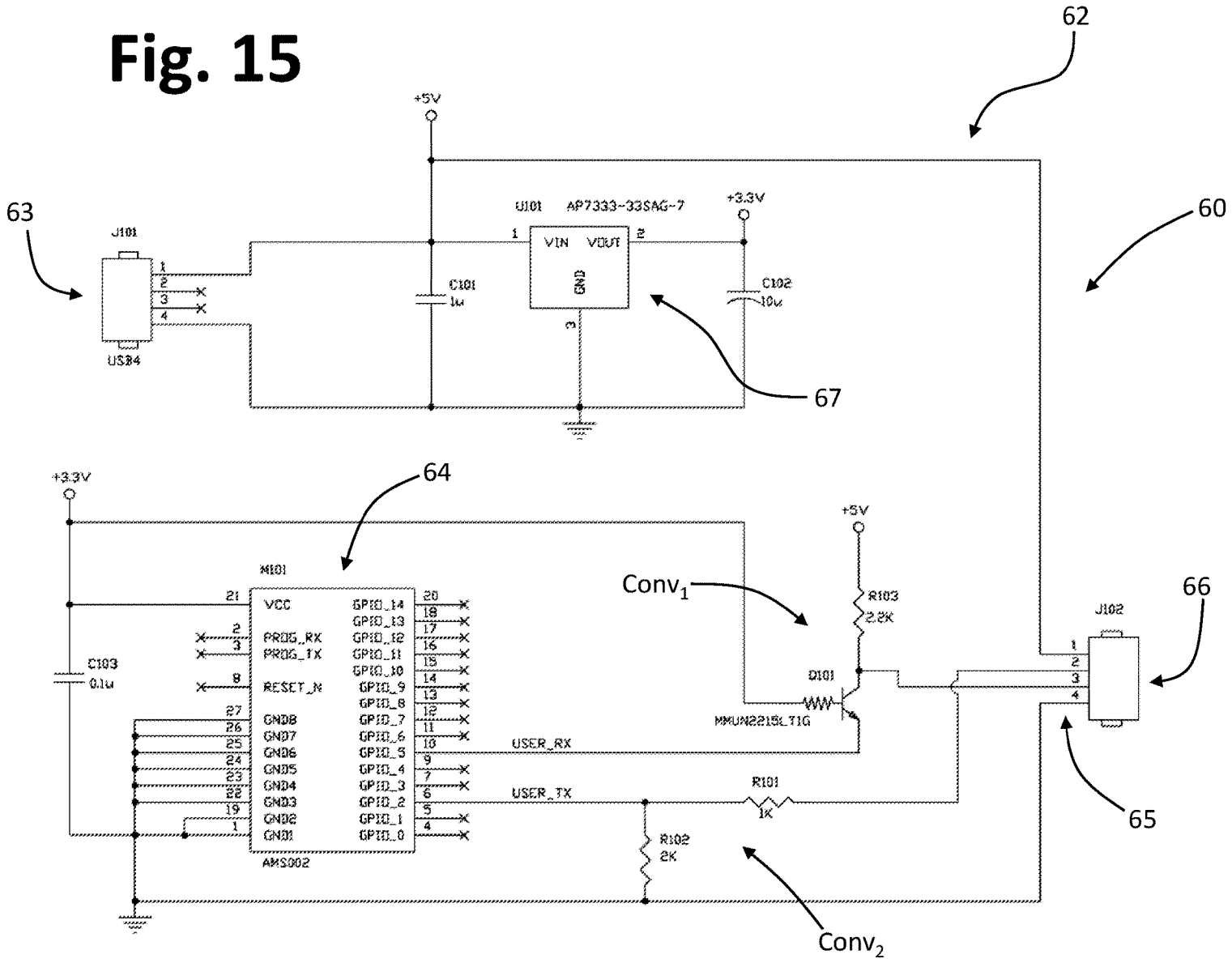
FIG. 15 is a possible circuit diagram of a functional module that can be used in a device according to an embodiment of the invention.

FIG. 15 illustrates a possible diagram of the circuit 62 of a communication module 60, which, in the case exemplified, includes a voltage reducer 67 for supplying the transceiver circuit 64 at a voltage (here 3.3 Vdc nom.) lower than the one supplied by the power-supply module 50 and necessary for supplying the main module 70 (here 5 Vdc nom.). As may be noted, connected to the connector 66 of the module 60 are an input and an output of the integrated circuit that implements the transceiver circuit 64, for wired transmission and reception of signals to/from the module 70, in particular a transmission of a serial type, as well as the positive and negative or ground of the supply voltage for the module 70 itself (where preferably this negative or ground operates also as common reference for the aforesaid serial reception and transmission signals). As has already been mentioned, by way of example, the radiofrequency data transmission and reception to/from the programming device 100 carried out by the integrated circuit 64 may be performed according to the Bluetooth standard, in which case the circuit can be implemented by a chip of the AMS00x family manufactured by ACKme Network, for example the chip AMS002 (the reader is referred to the corresponding data sheet for detailed information).

The circuit 62 preferably includes a first conversion arrangement, for instance as the one denoted as $Conv_1$, for bringing the lower-voltage signals (here 3.3 Vdc) at output from the integrated circuit 64 to the higher voltage required, at input, by the main circuit 70 (here 5 Vdc), as well as a second conversion arrangement, for instance as the one denoted as $Conv_2$, for bringing the higher-voltage signals (here 5 Vdc) arriving from the main circuit 70 to a lower voltage that can be accepted at input by the integrated circuit 64 (here 3.3 Vdc).

Figure 16:
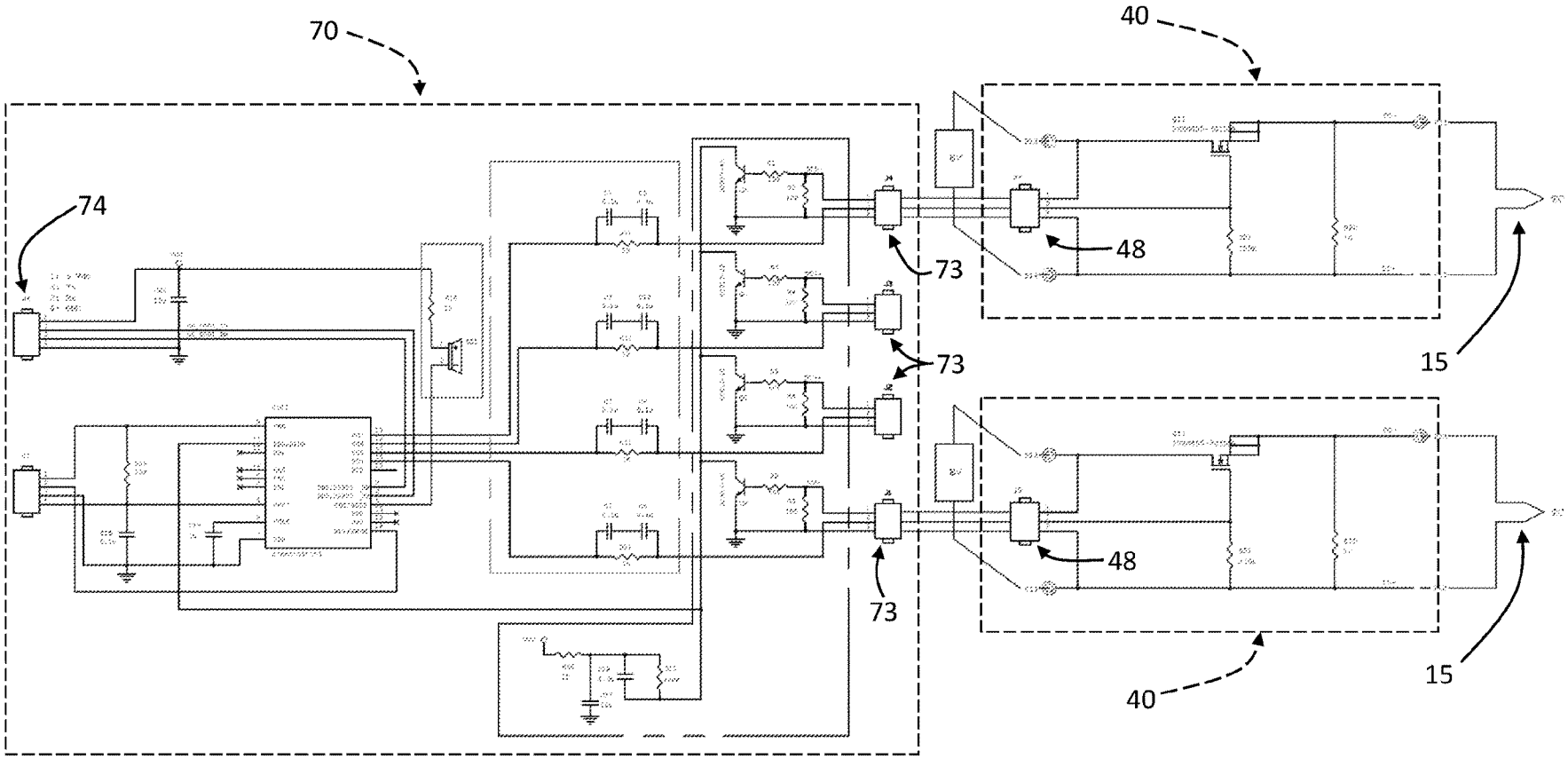
FIG. 16 is a possible circuit diagram of further functional modules that can be used in a device according to an embodiment of the invention.

FIG. 16 illustrates a possible diagram regarding a main module 70 with two switching modules 40 connected thereto. In the case exemplified, the circuit of the main module 70 is configured for connection of four switching modules 40. The circuits of the modules 70 and 40 are visible in greater detail in FIGS. 17 and 18, respectively.

Figure 17:
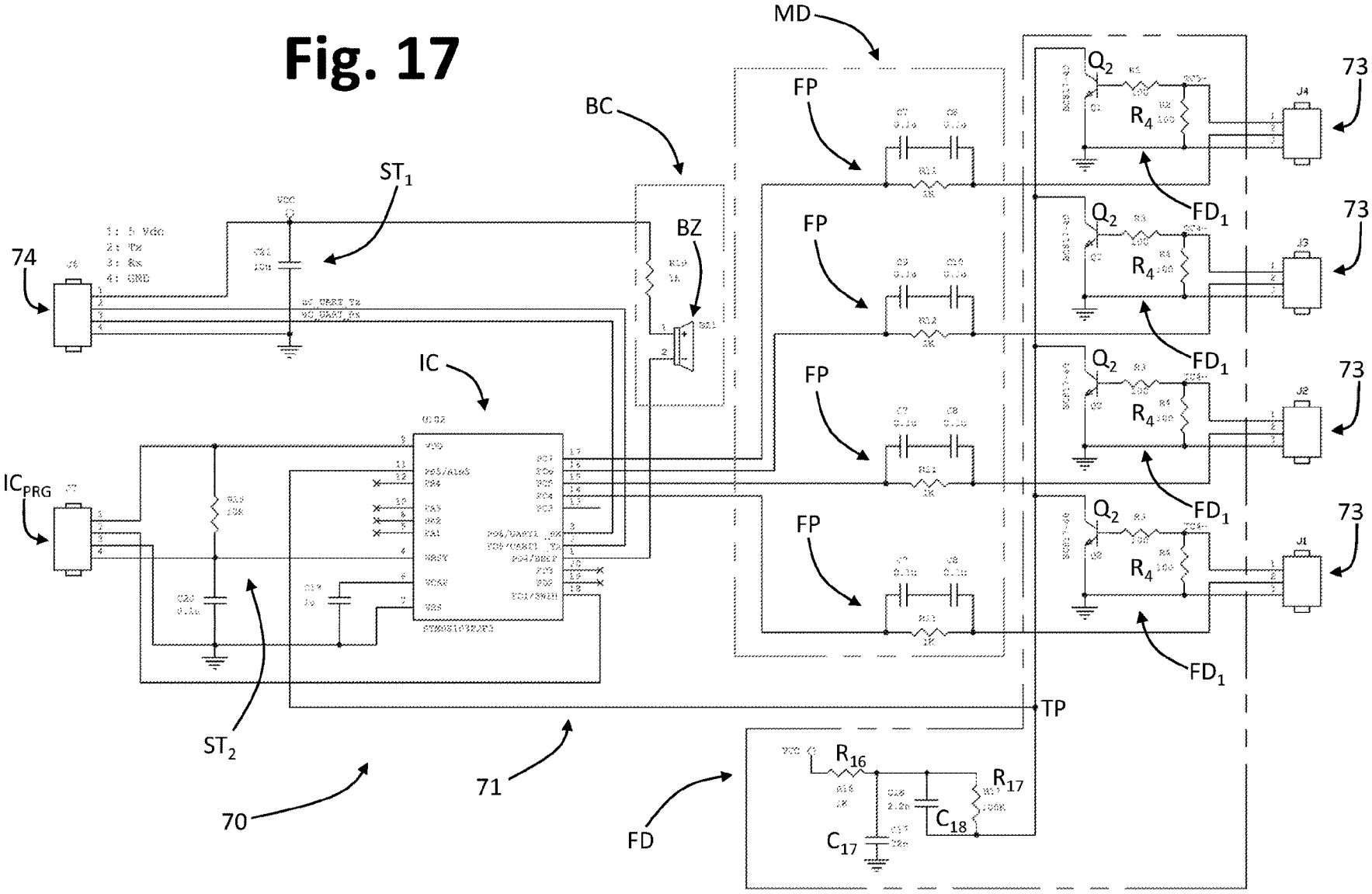
FIGS. 17 and 18 illustrate at an enlarged scale the circuit diagrams of two different functional modules of FIG. 16.

FIG. 17 illustrates a possible diagram of the circuit 71 of the main module 70, with the corresponding connector 74 for connection to the connector 66 of the communication module 60, as well as the connectors 73, each for connection to a connector 48 of a respective switching module 40.

The circuit includes a microcontroller IC, provided with corresponding programming port $IC_{PRG}$, which constitutes the central processing unit of the system and residing in which is the program that supervises operation of the device 30. In various embodiments, the microcontroller IC is exploited for the purposes of setting the time intervals for supply of the burners, for corresponding counting of the times, for control of the switching circuits of the modules 40 and of an acoustic-warning circuit, for flame detection at the controllable burners, and for generation of the signals directed at the programming device 100, in particular for purposes of display on the corresponding screen 100*a* and/or for warning purposes. The microcontroller IC is preferably a low-consumption one.

The circuit 71 includes, downstream of the connectors 74 and $IC_{PRG}$, respective arrangements for stabilisation of the input voltage, for example of the type as those denoted as $ST_1$ and $ST_2$, as well as an acoustic-warning stage, comprising a buzzer BZ, driven by the microcontroller IC, for generation of sound warnings of the type already mentioned previously. Designated by MD is a stage for driving the switching circuits of the modules 40, which comprises a number of arrangements, for example of the type denoted by FP, for filtering and/or protection of the command signals of the corresponding controlled switches. These command signals are generated by the microcontroller IC on its dedicated outputs, each connected to the respective arrangement FP. The signals, filtered and protected, reach a corresponding terminal of the respective connector 73 and, via the homologous terminal of the connector 48 and the corresponding conductor 47*a* (see FIG. 18), the control signal is sent to the switching device or switch 43. In the case exemplified, where the device or switch 43 is an electronic device, such as a MOSFET, the command signal corresponds to a voltage equal to the supply voltage of the circuit 71, here 5 Vdc, which guarantees the state of conduction of the MOSFET itself, and hence closing of the circuit and/or of the connections 46*a* and 47*b* between the thermocouple and the electromagnet of the safety valve of the tap (see the references 15 and EV in FIG. 18, respectively), which enables flow of gas to the controlled or controllable burner. Instead, by interrupting supply to the MOSFET, this passes into a state of non-conduction, which brings about opening of the circuit and/or of the connections 46*a* and 47*b* between the thermocouple and the electromagnet, with consequent closing of the safety solenoid valve and interruption of the flow of gas to the burner.

The module 70 moreover includes a circuit configured for detecting, via each switching module 40, the flow of current in the thermocouple-electromagnet circuit of a corresponding gas tap in order to conclude whether a flame is present on the corresponding burner. This detection circuit may be provided according to any technique known in the sector. In a preferred embodiment, however, the modality of detection of the presence of a flame is substantially of the type described in WO 2013/175439, i.e., based upon detection of the overvoltages that are generated across the coil of the electromagnet of the safety valve of the tap following upon sudden interruptions of the circulating current. Preferably, the same controlled device or switch 43 that has the function of interrupting of the current upon expiry of the programmed time is driven so as to open the circuit periodically for a brief instant (for example, for a few microseconds every 10 ms). In the presence of sufficient current(≥100 mA), immediately after interruption of the current in the electromagnet, the presence of a variation of voltage or an overvoltage determines charging of a capacitance, the voltage of which across it is measured by an A/D converter of the microcontroller IC. The very short periodic interruption of current is such as not to cause tripping of the safety valve of the tap, whereas the presence of the aforesaid variation of voltage or overvoltage is considered indicative of the fact that, at the moment of the very short interruption, the thermocouple generates e.m.f., and hence a flame is present.

A possible detection circuit of this type is denoted as a whole by FD in FIG. 17 and includes a plurality of detection stages $FD_1$, each for a corresponding connector 73 (i.e., for each switching module 40 associated to the main module 70). By suddenly interrupting the current in the thermocouple-electromagnet circuit of the safety valve, if current circulates in this circuit, generated across the coil of the electromagnet is a self-induced e.m.f. (see once again the references EV and 15 of FIG. 18, which refer, respectively, to the aforesaid electromagnet and thermocouple). The controlled switch of the module 40 considered (see the reference 43 of FIG. 18, where the switch is represented by a MOSFET) is then opened temporarily (for a few microseconds every 10 ms), under the control of the microcontroller IC. When the switch 43 opens, the self-induced e.m.f. generates a short overvoltage on the base of the transistor $Q_2$of the stage $FD_1$ considered. The transistor $Q_2$ goes into saturation, charging the capacitor $C_{18}$ and bringing the node TP to a voltage value lower than that of supply of the circuit (in the example, the node TP is normally at 5 Vdc). The microcontroller IC, after having driven the aforesaid opening of the switch 43, immediately carries out, via an input thereof provided with A/D converter, a voltage reading on the node TP and checks whether the voltage value is lower than a certain threshold. Preferably, a resistance $R_{17}$ is provided for discharging the capacitor $C_{18}$ after the switch 43 has reclosed the thermocouple-coil circuit and for then bringing the node TP back to the normal voltage (in the example, 5 Vdc). Once again preferably, a capacitor $C_{17}$ is provided that functions as charge tank for the capacitor $C_{18}$, as well as a resistance $R_{16}$ for recharging the capacitor $C_{18}$, so limiting the impulsive current absorbed by the entire circuit. At least one resistance ($R_1$-$R_4$) may be used for limiting the self-induced voltage value upon opening of the thermocouple-coil circuit and for adjusting the sensitivity of the circuit.

As has been said, the modalities of detection of the presence of flame may be implemented also in another way. For instance, in a possible alternative embodiment (not illustrated), the detection circuit is based once again on a very brief opening of the controlled switch 43 of the module 40 (FIG. 18), such as not to cause opening of the safety valve: when the controlled switch 43 opens, the thermocouple 15 is briefly disconnected and, when the voltage on the thermocouple is measured, a voltage difference must thus be found. Hence, in practice:

i) the thermocouple voltage is measured prior to opening of the controlled switch 43;

ii) the controlled switch 43 opens;

iii) the measurement is repeated; and iv) a check is made to verify whether there is a substantial difference between the two measurements.

To measure these voltages (which are of the order of millivolts) a high-gain amplifier may be used, for example obtained with just one transistor decoupled in d.c. at input by means of a capacitor.

Figure 18:
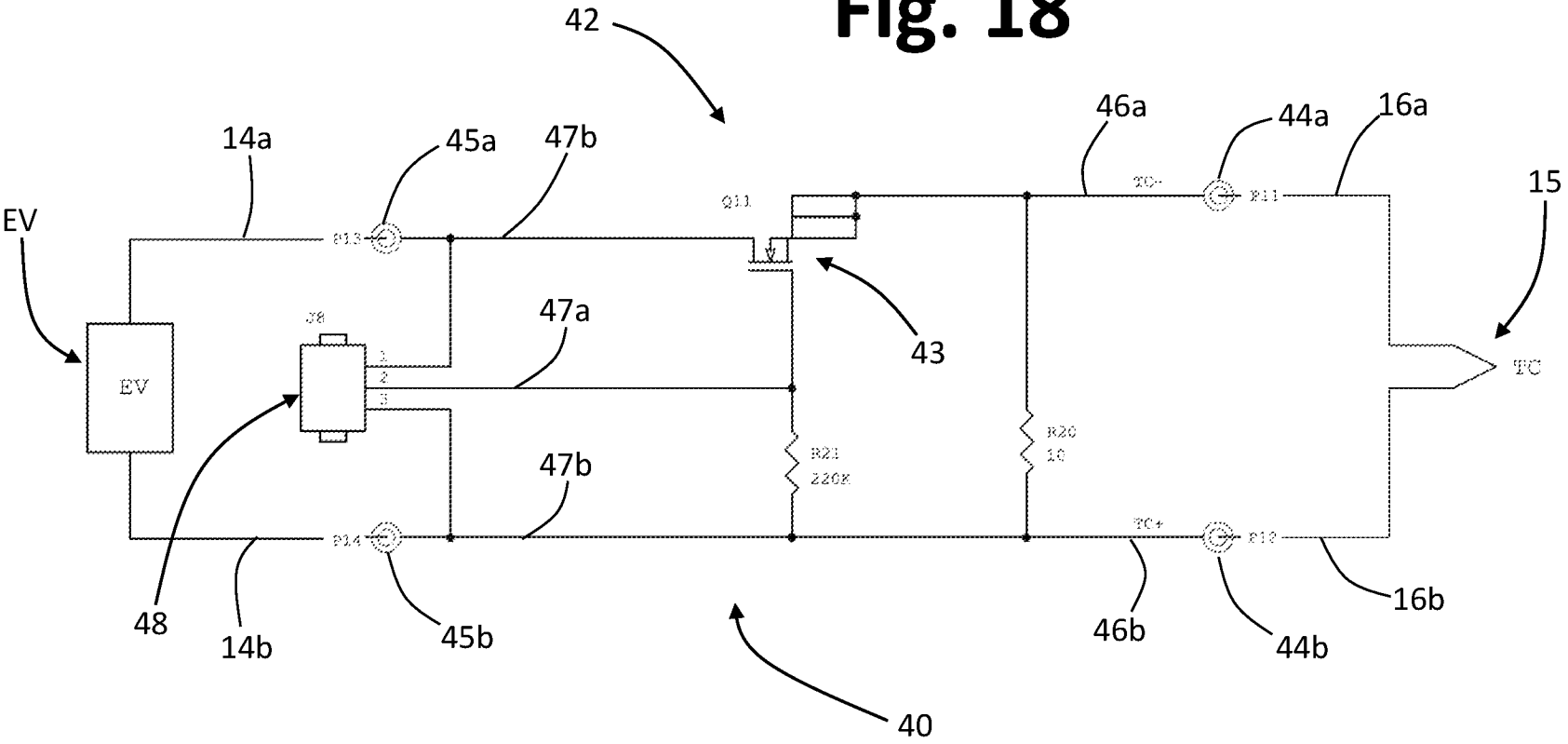

FIG. 18 shows a possible diagram of the circuit 42 of a switching module 40, with the corresponding connectors 44 (44*a*+44*b*) and 45 (45*a*+45*b*) for connection, respectively, to the thermocouple 15-16 and to the terminals of the electromagnet, designated by EV, of the safety solenoid valve of the gas tap controlled by the module 40 illustrated, as well as with the connector 48 for connection to a respective connector 73 of the circuit 71 of the main module 70 (see FIG. 17). As has been said, the circuit of the module 40 is essentially based upon the use of a switch 43 or other switching device, preferably of an electronic type, such as a MOSFET, which is driven by the module 70, especially by its microcontroller IC.

In the presence of mains voltage or battery voltage that supplies the device 30, the circuit 42 comprising the switch 43 is preferably in a closed configuration; i.e., it is normally in the state of conduction of the switch or MOSFET 43, hence with the thermocouple 15-16 connected to the electromagnet EV.

Upon expiry of a timing set previously, the main module 70 governs opening of the switch 43, in particular inducing a positive voltage on the line 47*a*, which interrupts the circuit between the thermocouple 15-16 and the electromagnet EV. This opening has a duration sufficient (for example one second) to bring about closing of the safety solenoid valve, and hence interrupt the flow of gas for supply to the controlled burner, the flame of which is consequently extinguished.

An example of operation of the device 30 is described in what follows.

After installation of the appliance 1 provided with the device 30, the communication module 60 is connected to the power-supply module 50, which is in turn connected to the mains and/or equipped with a battery. In this way, also the main module 70 is turned on. In this stage of installation, the main module 70, via its own microcontroller IC, carries out a reset of all the switching modules 40 present by opening for a brief time (for example one second) the corresponding controlled switches 43. This brings the appliance 1 into a safety state, where all the burners are certainly turned off.

Next, the communication module 60—and specifically its transceiver circuit 64—sets itself in a wait state. In other words, the module 60 is supplied and the circuit 64 is ready to receive requests for connection in wireless mode from an external user interface, represented by the electronic programming device 100, also defined for simplicity hereinafter as "smart device".

The connection between the smart device 100 and the transceiver circuit 64 requires execution of a prior step of mutual recognition or pairing, with mutual exchange of data, and/or identification and/or enabling codes, which can be carried out according to modalities generally known as regards the communication protocol, where the data and/or codes are preferably predefined for the purposes of the invention. For instance, and given that on the smart device 100 there must have been previously enabled a corresponding function of radiofrequency communication (for example, Bluetooth if this is the standard used in the device according to the invention), the management program (for example in the form of a so-called app) dedicated to operation with the device 30 is started on the smart device 100. The smart device 100 then proceeds with the search for devices that can be connected in radiofrequency according to the invention. The program in question is preferably prearranged for highlighting only control devices 30 of the type considered herein, without allowing the possibility of exchange of signals with other devices operating in radiofrequency that might be present in the surrounding area. The connection, i.e., the effective pairing between the transceiver circuit 64 and the smart device 100, may be obtained by entering a code for recognition of the appliance 1, for example made available at the moment of purchase of the appliance itself. For reasons of secure transmission, the connection between the smart device 100 and the control device 30 is unique (univocal). Preferably, the connection of a smart device 100 to the control device 30 is made possible only if the latter is not already connected in radiofrequency with another smart device 100. The possible loss of the connection may, moreover, be verified and notified. For this purpose, the device 30 and/or the smart device 100 may be provided with appropriate functions of control for the aforesaid unique and/or continuous connection.

After pairing has been completed, the smart device 100 forwards, via the aforesaid program, a command for request for information to the control device 30. This command for request for information is preferably sent only once, at the moment of initial connection of the smart device 100, in order to recognise the type of appliance 1 and/or the type of device 30 installed thereon, with corresponding indication of how many and which burners are connected to the device 30.

The response generated by the main module 70 and transmitted by means of the transceiver circuit 64 of the module 60 is preferably a sequence of data or an identifier string (for example, a 48-bit code, preferably corresponding to the physical MAC—Media Access Control—address of the circuit 64), which is unique for each device 30. Via said identifier string, the smart device 100 may, for example, create and then present to the user a graphic image representing the layout of the cooking appliance 1 considered, at least as regards the spatial arrangement of its gas burners. The graphic image may be fetched from a database resident in the memory of the smart device 100, or else from an on-line database that the smart device accesses, for example via the Internet. In addition to the identifier string of the appliance 1, the module 70 communicates with the smart device 100, once again via the transceiver circuit 64, also a further sequence of data or string aimed at indicating how many and which burners are controlled by the device 30 and by respective switching modules 40. The graphic image is consequently generated on the screen 100*a* of the smart device 100.

In preferred embodiments, the device 100 and/or the corresponding dedicated program, are/is prearranged in a such a way that, represented on the screen 100*a* are at least:

- an image representing the appliance or at least its area provided with burners, for example a photographic or stylised image;
- an indication of which burners are controllable, i.e., have associated the device 30 and/or a respective switching module 40, and which are not;
- for the controllable burners, an indication of the corresponding state, whether on or off; and
- for the burners currently lit, an indication representing the time elapsed from lighting thereof or the time elapsed from start of counting and/or the time that still has to elapse before the flame is extinguished.

Figure 19:
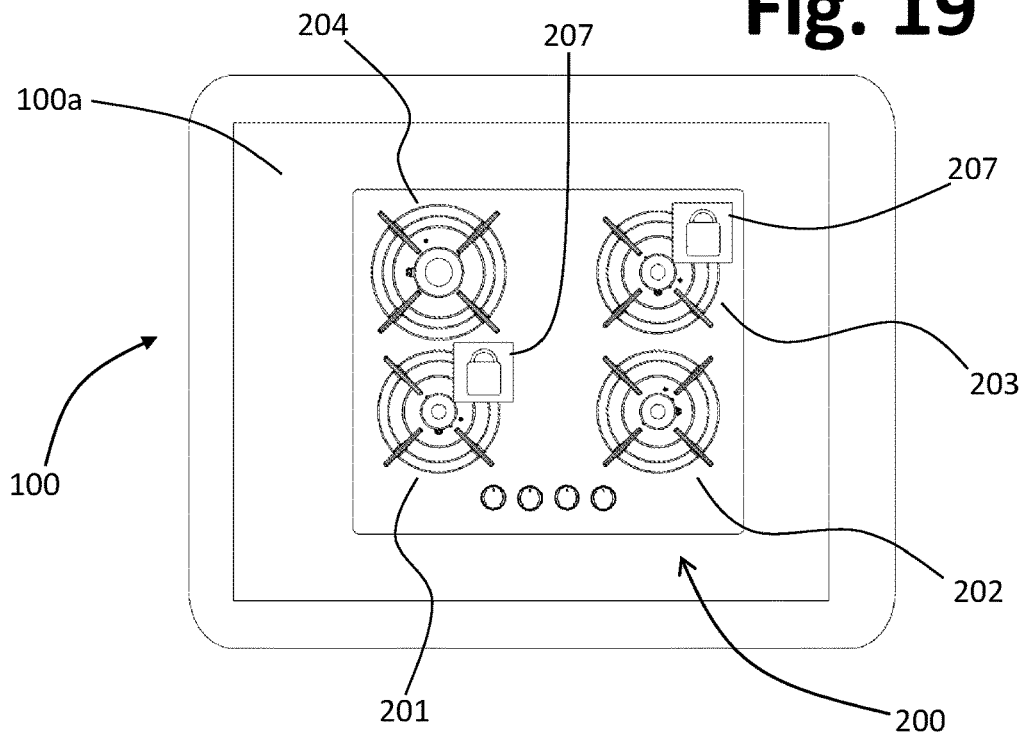
FIGS. 19-22 are schematic views aimed at exemplifying possible modes of graphic representation of operating information regarding a device according to possible embodiments of the invention.
Figure 20:
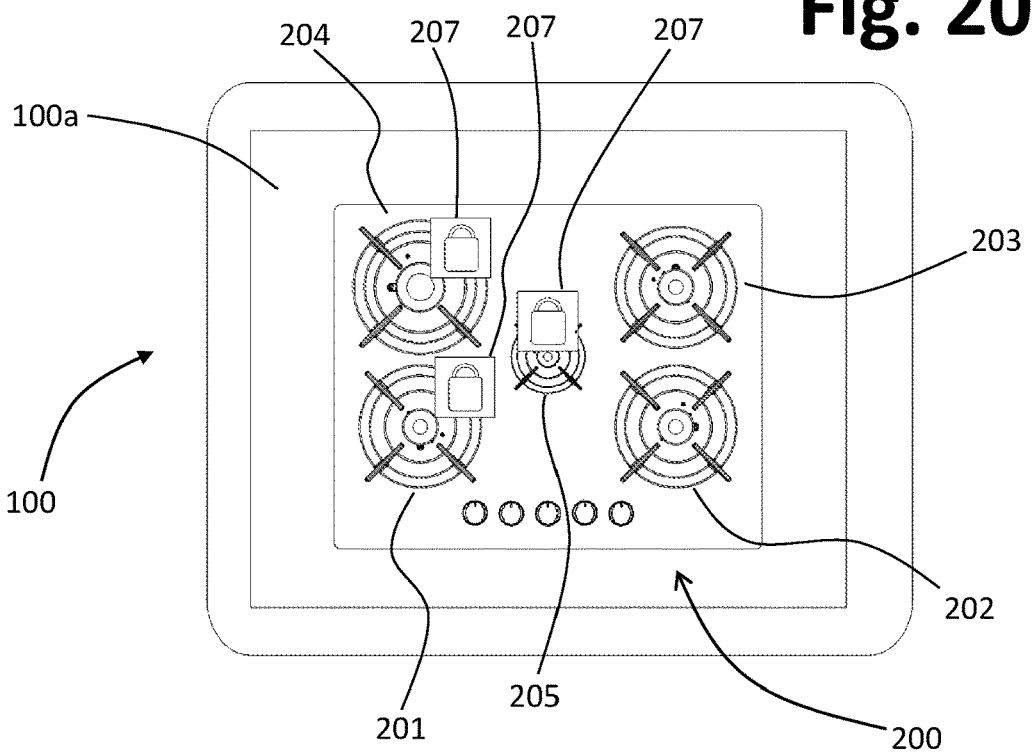

FIGS. 19 and 20 represent by way of example two possible displays that are represented at the end of the procedure of pairing between a smart device 100 and a control device according to the invention, in the case of a device that equips an appliance provided with four burners and a device that equips an appliance provided with five burners.

In these figures, designated by 200 is the graphic image representing the appliance 1 in question, in the example a cooking hob, with the representation of its burners, designated by 201-204 and 201-205, for FIGS. 19 and 20, respectively. Designated by 207 is a representation, such as a graphic symbol, aimed at identifying which of the burners of the appliance are not controllable by the device according to the invention. In the example, this indication is constituted by the representation of a closed lock, but other symbols are obviously possible (for example, a red light), as likewise it is evidently possible that the indication in question identifies the controllable burners (for example, an open lock or a green light), instead of the non-controllable ones. Consequently, in the examples illustrated, only the burners 202 and 204 of FIG. 19 and the burners 202 and 203 of FIG. 20 are controllable by the device.

Figure 21:
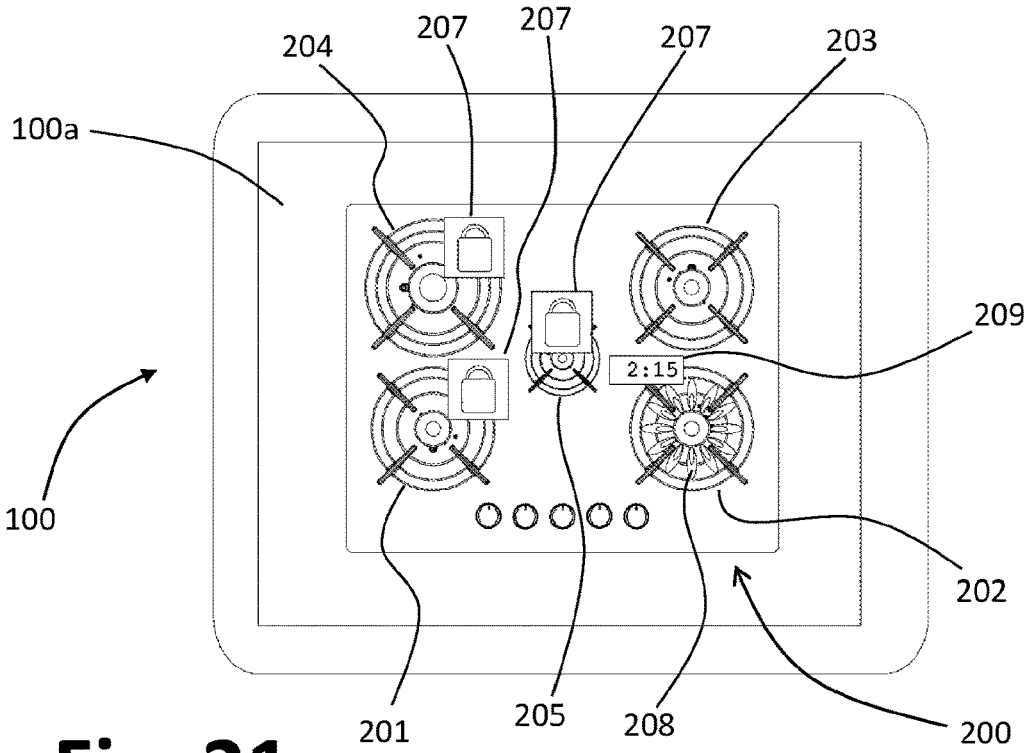

FIG. 21 refers to the same case as that of FIG. 19 (appliance with five burners of which only the burners 202 and 203 are controllable by the device), where designated by 208 is an example of a possible indication or graphic representation of state of a burner that is lit. As may be noted, in the case illustrated, for the burner 202 the representation 208 of a flame is moreover highlighted, which represents the on state of the burner in question. Instead, such a representation is absent for the other controllable burner 203, a circumstance that indicates the fact that the burner is off. Once again in FIG. 21, in relation to the burner 202 a further indication 209 is shown, here in numeric form, representing the time elapsed from lighting of the burner or from start of the time count. Preferably, this indication 209 is updated periodically, for example every second, in order to provide a dynamic representation of the passage of time.

The type of representations described, and exemplified in FIGS. 19-21, may be envisaged also during normal use of the smart device 100, i.e., after its initial connection to the device 30, following upon start of the dedicated program.

In various embodiments, the smart device 100 and/or the dedicated program that equips it are/is configured for enabling input of at least the following commands, for each controllable burner:

- reset of the time elapsed from lighting of the burner;
- countdown time for turning-off of the burner, i.e., the desired time interval of supply of gas to the burner.

Possibly, the program may also be configured for enabling input of a command for remote turning-off of the burner, via the smart device 100. In this case, the smart device 100 transmits a turning-off signal that is detected by the module 60, which in turn transmits it to the module 70, which identifies it and accordingly governs the corresponding module 40 in order to bring about an interruption or reduction of the electromotive force generated by the thermocouple 15 associated to the burner that is to be turned off, thereby causing opening of the corresponding safety solenoid valve EV and interruption of the flow of the gas to the burner concerned.

In various embodiments, the smart device 100 and/or the dedicated program are/is configured in a such a way that, after the user has set a timing for one or more burners, on the corresponding screen 100*a* the following information is displayed:

- an image representing the flame on the corresponding burner;
- an indication of the time elapsed from turning-on of the burner or from setting of the time count, preferably of a numeric type;
- an indication of the time remaining before the burner is turned off, preferably of a numeric type.

There may be possibly provided also a graphic indication of the time elapsing on a graphic progress bar.

Figure 22:
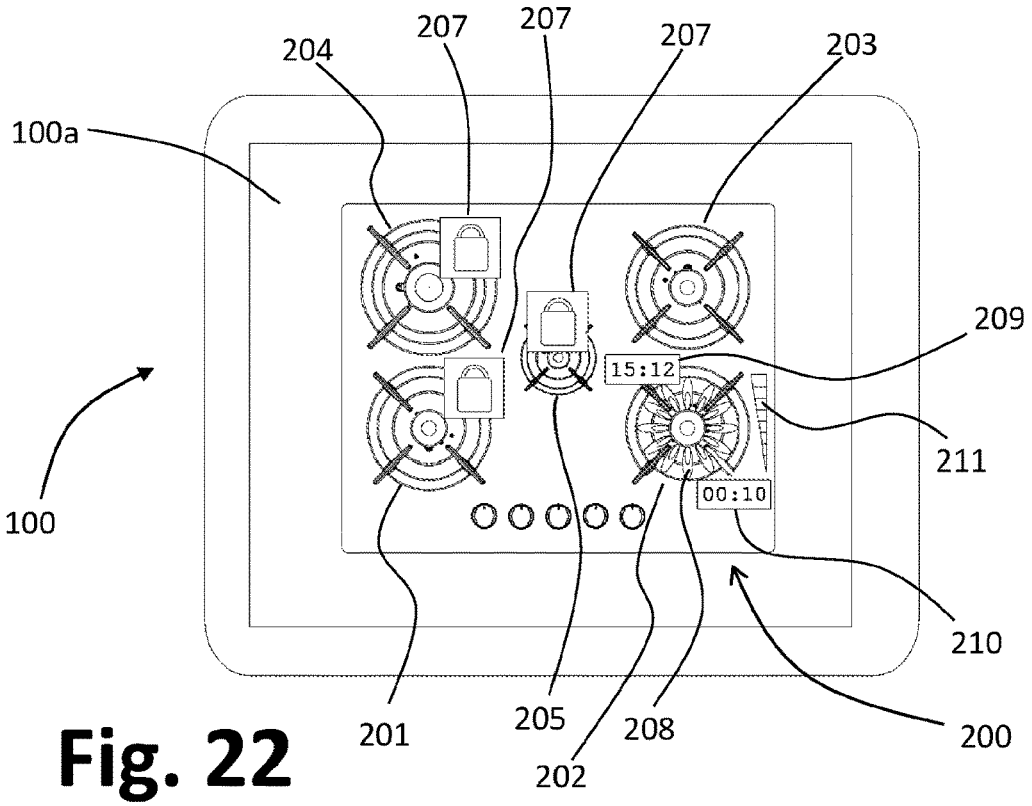

A case of this sort is exemplified in FIG. 22, which also regards an appliance with five burners of which only the burners 202 and 203 are controllable by the device according to the invention, where for the burner 202 a timing has been previously set. As may be noted, in addition to the indication 208 of burner lit and to the indication 209 of time elapsed from lighting of the burner or from start of count, in this case also a further indication 210 is provided, here in numeric form, representing the remaining time of supply of the burner 202 prior to expiry of the time interval set. Also a representation of this sort is preferably updatable, in the form of countdown. As has been said, it is also possible to provide a graphic indication of the time elapsing on a graphic progress bar, here exemplified by the representation designated by 211.

As explained previously, the smart device 100 monitors periodically the state of the cooking appliance, sending periodically to the device 30 an updating request, for example every second. Starting, for instance, from a condition of the type illustrated in FIG. 20 with burner 202 off, when the burner 202 is lit, the smart device 100 then receives from the device 30—in response to an updating request—the information that the burner is lit and how long it has been lit (for example, in seconds), it thus being possible to update the graphic display, as shown in FIG. 21. This information is periodically updated, following upon the successive requests of state by the smart device 100 and corresponding replies by the device 30.

In the condition of FIG. 21, the user can program a time for supply of the burner 202, for example by selecting from the touch screen the image of the burner in question, in order to cause thereby display of a corresponding graphic interface necessary for entry of a numeric value of the turning-off time. When the value of the turning-off time has been set, the smart device 100 transmits the corresponding datum or command to the device 30, which prepares for carrying out the count or countdown, starting from the value received and stored. At the next updating of state, the device 30 communicates to the smart device 100 that for the burner 202 a time interval has been set for supply of gas and that a countdown is in progress, as represented schematically in FIG. 22. The graph regarding the burner 202 is then periodically updated, showing the numeric value of the remaining time and a possible graphic indication for indicating passage of time. Upon expiry of the time interval set, the device 30 will issue a command for turning off the burner 202 (the main module 70 governs opening of the switching circuit of the module 40 associated to the tap of the burner 202) and upon subsequent query of state by the smart device 100, the device 30 will reply so as to generate on the smart device an image similar to that of FIG. 20.

To sum up, according to preferential examples of embodiment of the invention:

1) at the moment of initial association of a smart device 100 to the device 30, the smart device queries the microcontroller IC of the main module 70 in order to gather information on the appliance 1 necessary to establish the corresponding number of burners, how many, and which burners are controllable, and which display graphics to adopt; in response, the module 70 communicates the corresponding information and/or the identifier string of the appliance in order to associate the correct graphic to the cooking range connected; if all the necessary information on the appliance 1 is already stored in the device 30 (for example, in memory means associated to its microcontroller), it can be transmitted directly to the smart device 100; as an alternative or in addition, the device 30 transmits an identifier code via which the smart device 100 can gather other information on the appliance 1, which for example resides in the program loaded in the smart device 100 or can be downloaded from a remote database, for example accessible via a communication network or the Internet;

2) in normal daily use of the system, after the first association of the smart device 100, the dedicated program of the latter periodically queries the module 70 as regards the state of the controllable burners (on/off), obtaining in reply information regarding:

- identification of the controllable burners;
- which controllable burners are off and which are possibly on;
- for the controllable burners that are lit, the time elapsed from lighting thereof or from setting of the time; and
- for burners that are lit for which a supply interval has been programmed, the residual time prior to turning-off;

3) for the purposes of programming of a time interval for supply of a burner, via the dedicated program present on the smart device 100 the user can select a desired burner from among the controllable ones and set a corresponding supply time interval; in response, the main module 70 transmits a programming acknowledgement and/or activation of timing in the suitable form;

4) in the case where the user wishes to cause from remote the interruption of supply of a controllable burner that is lit, via the dedicated program present on the smart device 100 the user can select the desired burner and confirm the choice of forced turning-off.

In the case where the device 30 and/or the program that equips the microcontroller IC of the main module does not receive correct commands according to the syntax established, via the modules 70 and 60 an adequate error message is returned, transmitted to the smart device 10 and appropriately notified by the latter to the user.

In various embodiments, in the case of loss of radiofrequency connection (for example, because the smart device 100 has been turned off or has been taken to far away from the transceiver circuit 64), the system according to the invention activates safety operating modes, for example behaving as follows:

- the appliance 1 continues to function in an independent way: the controlled or controllable burners can be controlled manually via the corresponding taps; if for a burner a supply time interval has been set, this continues to be counted by the microcontroller IC of the main module 70, until programmed turning-off, even in the absence of connection to the smart device 100; hence, in other words, the module 70 is perfectly autonomous in management of interruption of supply of gas to a controlled burner;
- the dedicated program that equips the smart device 100 warns the user of loss of connection, preferably continuing to show the last state detected of the appliance 1; in the case of controllable burners that are lit or of timings set for one or more controlled burners, the program continues to show the presumed state of the appliance, with display of the times (time elapsed and time remaining) of presumed operation.

In various embodiments, in the case of absence of the mains voltage that supplies the power-supply module 50, the main module 70 turns off, with consequent opening of the controllable switches 43 and hence with interruption of the thermocouple-electromagnet circuit of the taps of the controllable burners: consequently, in the case where controlled or controllable burners are lit, the latter are turned off and cannot be used until the mains voltage returns. Instead, possible burners of the appliance 1 that are not controlled by the device 30 can be used normally also in the absence of the mains voltage. Once the mains voltage returns any possible turning-off times set are reset to zero.

As explained previously, in possible embodiments, the device 30 is provided with a backup battery, preferably housed in a module external to the appliance, very preferably the communication module 60 (see what has been described previously in relation to FIG. 10). A possible circuit implementation in this sense of the module 60 is exemplified in FIG. 23, where the circuit 62 comprises a backup battery 68, which steps in for the power mains supply as soon as this latter fails, thanks to the action of a changeover-switch circuit DV here comprising two diodes.

In this implementation, then, the module 70 downstream of the module 60 is supplied at the voltage at output from the voltage regulator or voltage reducer 67 or alternatively at the voltage of the backup battery 68, not considering the possible voltage drops across the changeover-switch circuit DV. It should be noted that the functions of the changeover-switch circuit DV can be implemented in any other way, for example using for this purpose a dedicated power switch of a type in itself known, designed to insert the battery 68 into the circuit in the case of absence of the mains voltage.

Figure 23:
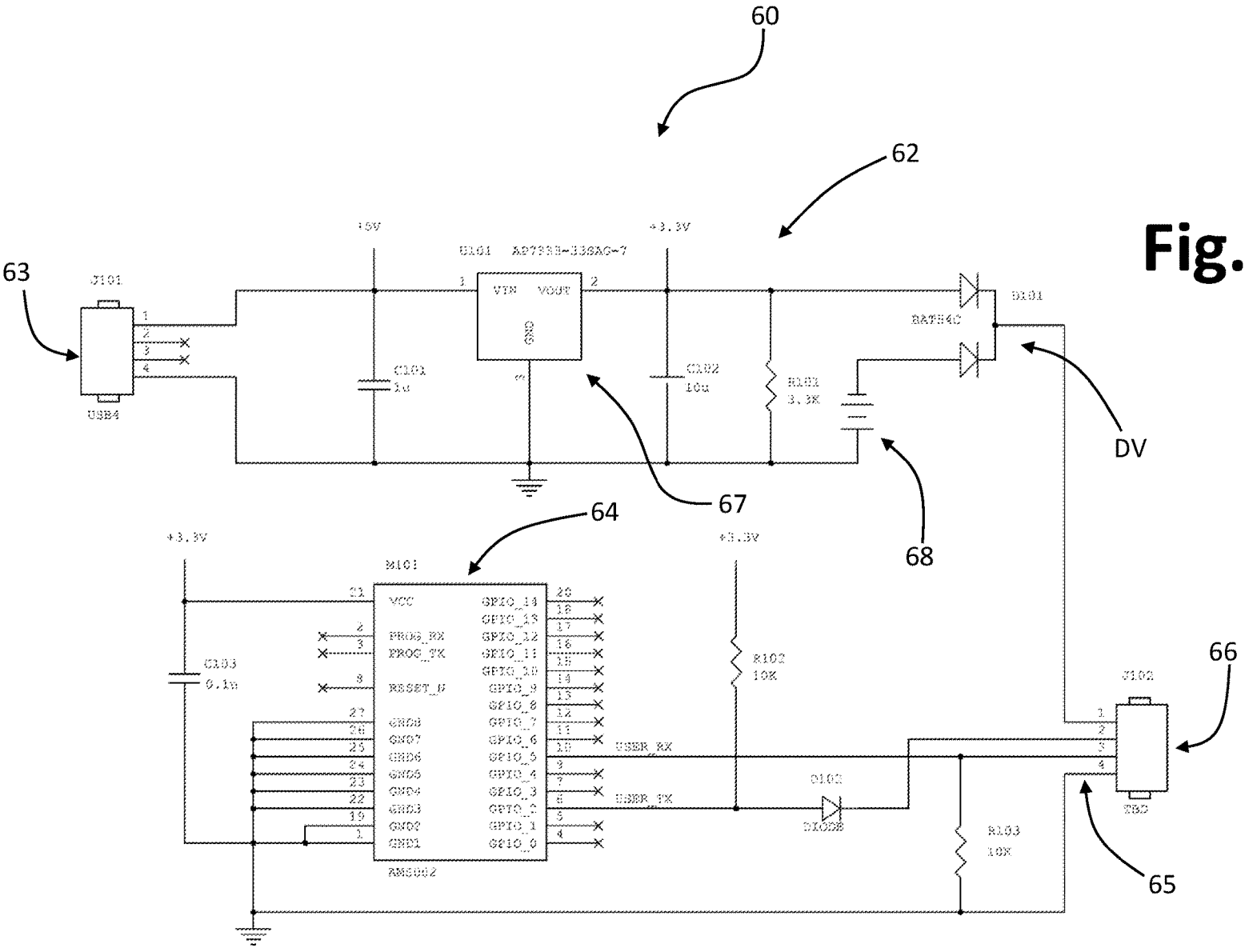
FIGS. 23 and 24 are possible circuit diagrams of variant embodiments of the functional modules of FIGS. 15 and 17.
Figure 24:
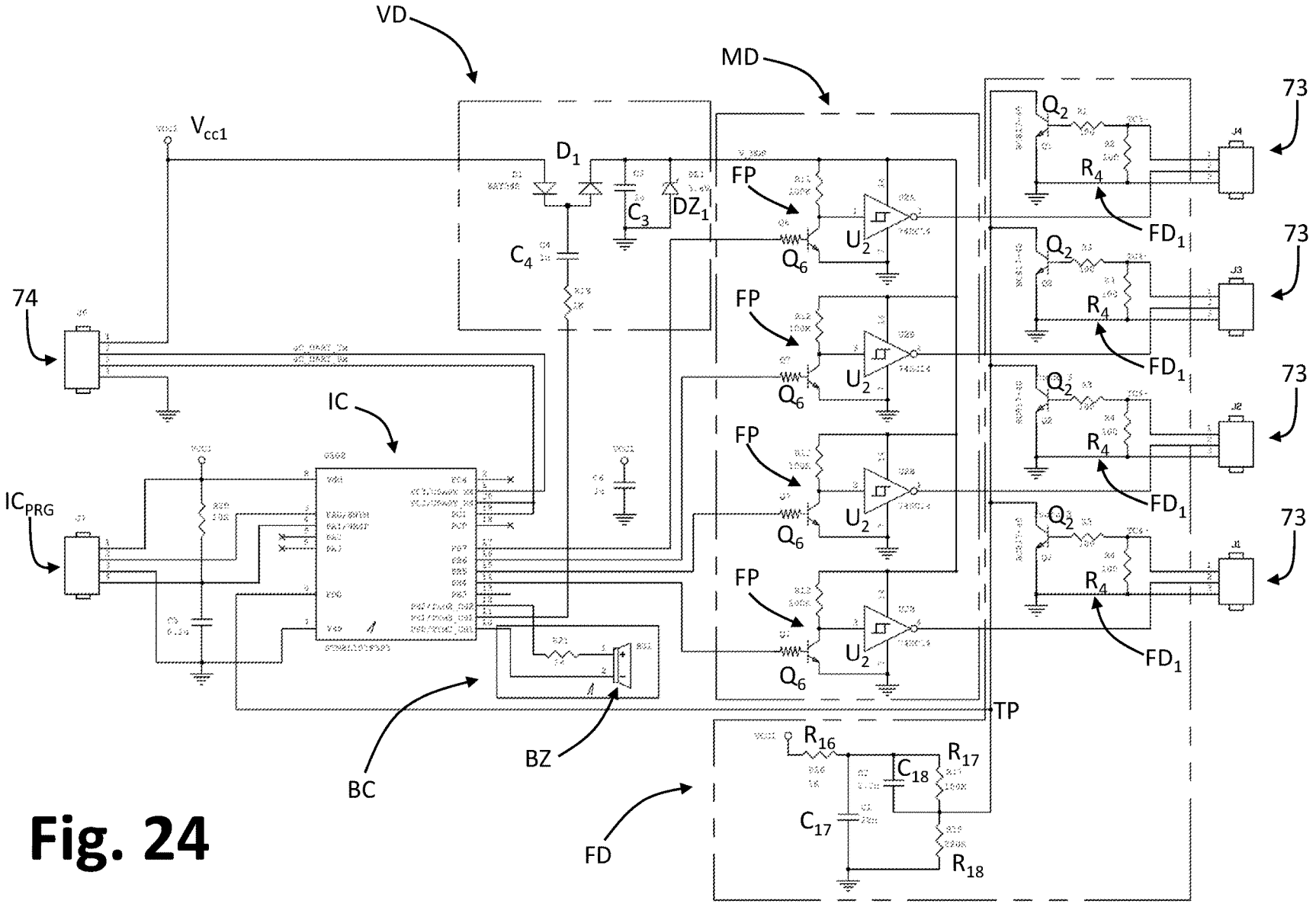

FIG. 24 illustrates a possible circuit diagram of a module 70 that can be supplied via the voltage at output from the voltage reducer 67 or alternatively via the voltage supplied by the backup battery 68 of FIG. 23, assuming that the corresponding voltage $V_{cc1}$ is approximately 3.3 Vdc nom. and that the control signals of the controllable switches 43 of the switching modules 40 (FIG. 18) require a voltage higher than $V_{cc1}$ (i.e., a voltage higher than the one that supplied by the battery 68), for example 5 Vdc. In this implementation, the circuit 71 of the module 70 includes a charge-pump voltage booster or duplicator, designated as a whole by VD, driven by an oscillator internal to the microcontroller IC (for example, at 5 kHz), with a signal that can be considered similar to a square wave. When a corresponding output (PB1) of the microcontroller IC is at level 0 (signal low, ground), the capacitor $C_4$ charges from the supply $V_{cc1}$ through a section of the double diode D1 at approximately 1 Vdc (but for the voltage drop on the diode). When the aforesaid output of the microcontroller IC goes to level 1 (signal high, towards $V_{cc1}$), the capacitor $C_4$ transfers its charge to the capacitor $C_3$ through the other section of the double diode $D_1$ (if the circuit were open, the voltage on the common node of the diode would go to approximately twice $V_{cc1}$ minus the drops on the diode). Irrespective of the voltage drops on the diode of the node D1, which at the end add up, the circuit VD hence operates as voltage duplicator. The current supplied is in any case relatively low, because in effect it is sustained by the capacitor $C_3$ alone, which is, however, designed for the purpose. Preferably, the circuit VD envisages, as a precaution, a Zener diode $DZ_1$ so that the voltage on the circuit itself will not exceed 6 Vdc.

The diagram provided by way of example in FIG. 24 further comprises a matching and/or control stage MD, in particular for enabling control by devices operating at a lower voltage (for example, 3.3 Vdc) of devices operating at a higher voltage (for example, 5 Vdc).

The switches 43 of the switching modules 40 are driven by standard digital CMOS ports, designated by $U_2$, supplied by the booster stage VD, for example at 5 Vdc. The transistors Q6 operate so as to match the levels 3.3 Vdc of the signals at output from the microcontroller IC with the signals at 5 Vdc for control of the switches 43 of the switching modules 40. This type of driving guarantees an output towards the switches 43 comprised between 0 and 5 Vdc, a low consumption (in view of possible supply via the backup battery), and a high rate of switching of the switches 43, when implemented by MOSFETs (which, having a high gate capacitance, must be driven with low impedances), and is economically advantageous.

The entire circuit presents an extremely reduced current consumption, which can hence be sustained by the voltage duplicator VD applied. The microcontroller IC used is a low-consumption one and is able to sustain regular operation of the control stage MD of the switches 43 with a very low current consumption compatible with long periods of battery operation.

In this case, the circuit 71 functions substantially at 3.3 Vdc. Supply at 3.3 Vdc is obtained, in the communication module 60 (FIG. 23), via the voltage regulator 67, starting from the 5 Vdc supply provided by the power-supply module 50. In the absence of mains supply, in the module 60 the backup battery 68 steps in. Via the voltage duplicator VD, even in the event of absence of the mains voltage, the microcontroller IC is able to continue to keep the switches 43 closed, i.e., to keep the MOSFETs that implement the aforesaid switches in a condition of conduction. In this implementation, it will be possible to continue to use the burners even in the absence of current from the electric mains supply.

The microcontroller IC in this version is able to function at 3 Vdc and does not have an A/D converter: the circuit FD for detection of the presence of a flame is hence connected to a logic input of the microcontroller IC, i.e., one having its own thresholds fixed at voltage levels close to $V_{cc1}$ and ground, corresponding to logic states 1 and 0. In the conditions of absence of a flame and non-intervention of the circuit FD, on the node TP the voltage is substantially at the value Vcc1, i.e., at the logic state 1.

In the conditions of presence of a flame and intervention of the circuit FD, on the node TP the voltage instead drops to ground, i.e., to the logic state 0. In a way similar to what has been explained previously, when the thermocouple-electromagnet circuit is interrupted, a brief overvoltage is generated on the base of the transistor $Q_2$ connected to the modules 40: this determines charging of the capacitor $C_{18}$, and the node TP goes to ground, to a voltage of state 0 lower than the supply voltage Vcc1, until the capacitor $C_{18}$ itself is slowly discharged via the resistance $R_{17}$. By way of precaution, in the circuit configuration of FIG. 24, there may be provided a divider resistance $R_{18}$ that previously brings the voltage at rest to a value lower than Vcc so as to facilitate reaching of the 0 threshold.

With the circuit configuration of FIG. 23, in the absence of the mains voltage the communication or transceiver circuit 64 is supplied, but its operation is preferably inhibited by the microcontroller IC for energy-saving purposes: there consequently ceases the exchange of information in wireless mode with the smart device 100 and, preferably, the device will operate as explained above in relation to the situation of loss of the radiofrequency signal (absence of updating of the graphic and impossibility of imparting commands via the smart device, until the mains voltage returns). However, in this case, the supply provided by the backup battery 68 prevents loss of the timings possibly set and enables continuation of the counts (on-time of the controllable burners and remaining time for supply of the controlled burners). The main advantage of this version is represented by the fact that in any case possible is manual use of the burners connected to the device 30 even in the absence of the mains voltage. Hence, in the battery version of FIGS. 23 and 24, at least the module 40 is operative even in the absence of mains voltage supply (110-220Vac), enabling use of the burners of the appliance 1, carrying through the counts that have possibly already started. In this operating condition, in particular with supply only via a small button battery, preferably some functions are not enabled for energy-saving purposes, for example by inhibiting wireless transmission with the smart device 100 (in so far as this activity requires a significant power level).

In various embodiments, in order to be able to use in a complete way the device 30 according to the invention even in the absence of mains voltage, there may advantageously be used batteries or electrical accumulators 68 having a sufficient power (W) and/or charge (Ah), in particular envisaging use of batteries 68 of a rechargeable type, preferably housed in the module 60, possibly provided for this purpose with a recharging circuit.

According to an autonomously inventive aspect, at least one battery or accumulator can be housed in the power-supply module 50, preferably provided for the purpose with a casing with an access hatch for possible replacement of the battery or accumulator. The battery in question may be a battery of a rechargeable type, with the power-supply module that includes a suitable circuit designed for recharging. In the absence of electrical mains supply, the aforesaid battery supplies the necessary voltage on the connector 53, for example approximately 5 Vdc, so as to be able to supply the modules 60, 70 and 40 and render them operative, also enabling wireless communication with the smart device 100.

As explained previously, a smart device 100 must be previously paired via a pairing procedure with the device 30. This may be carried out, for example, using the same program dedicated for management of the device 30, for example in the form of an application that the user can download directly from an Internet website, for example a website of the manufacturer of the appliance 1 or else of the manufacturer of the control device 30. Once the dedicated program has been installed and started, pairing of the smart device 100 with the device 30 may be carried out by entering a suitable unique recognition code, for example made available at the moment of purchase of the cooking appliance. Following upon pairing, the smart device 100 forwards, via the aforesaid program, a configuration-request command, in particular for recognition of the type of appliance and/or the type of device 30 installed thereon, with corresponding indication of how many and which burners are connected to the device 30.

This request can be forwarded to the device 30, the main module 70 of which generates the corresponding reply and transmits it by means of the transceiver circuit 64 to the smart device 100 so that the latter can be configured correctly. As has already been mentioned, the configuration parameters preferably enable also the smart device 100 to create the graphic image representing the layout of the cooking appliance considered, where the information necessary for creation of the image can be fetched from a database associated to the dedicated program, and hence resident in the memory of the smart device 100, or else from an on-line database to which the smart device 100 has access, for example via the Internet.

Alternatively, the parameters and the information of configuration can be retrieved by the smart device 100 via an Internet website of the type mentioned above, such as a program or a file of data accessible from the above Internet website of the manufacturer of the appliance 1 or else of the manufacturer of the control device 30.

In such an embodiment the smart device 100, via the dedicated program, can set up a connection through the Internet with the aforesaid remote web site or file, from which it receives the necessary parameters and information. In this case, the configuration-request command coming from the smart device 100 will include a unique identifier code of the device 30, which also identifies the appliance on which it is installed. The website will then send the necessary configuration parameters and information.

In various embodiments, the number and position of the controllable burners constitute information predefined by the manufacturer of the appliance 1. In possible embodiments, this information can be set by an installer, who, after sale of an appliance 1, equips the latter with a device 30 provided with a code predefined by the corresponding manufacturer. In this case, the installer can also be put in the condition where he can access a database (for example, on the web), onto which the corresponding data can be uploaded, for example by accessing a file location determined by the code of the device 30 and entering the configuration of installation chosen for the appliance on which the device 30 has been mounted, with an indication of how many and which burners have been associated to the device itself, perhaps with the possibility of selecting from among configurations that are predefined for various models of appliances 1.

Figure 25:
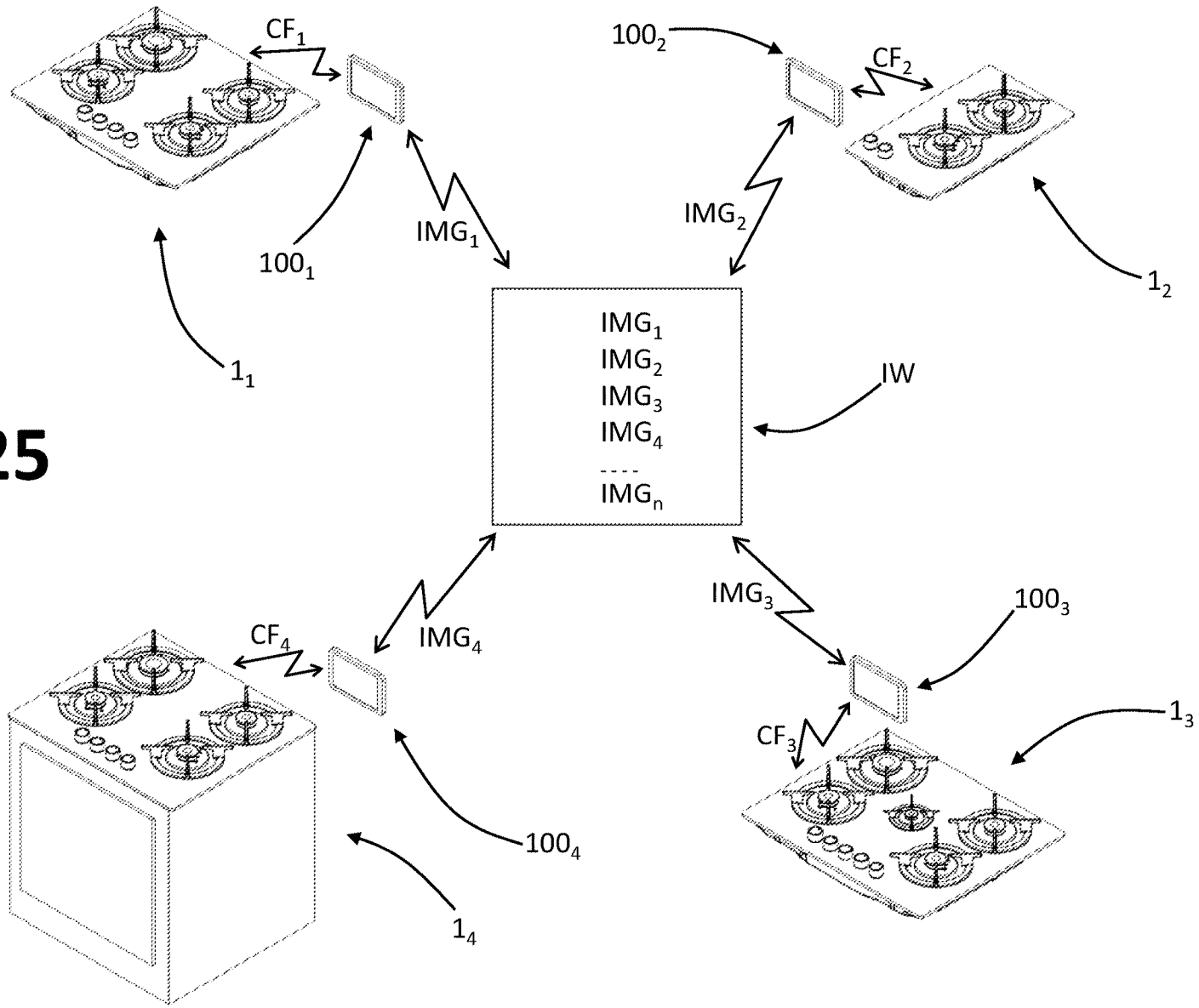
FIG. 25 is a schematic representation aimed at exemplifying a possible system that can be used for the configuration of devices according to the invention.

FIG. 25 is a schematic illustration of the concept of (partial or total) configuration of devices 30 associated to various types of appliances, here cooking appliances. In this figure, designated by $\mathbf{1}_1$, $\mathbf{1}_2$, $\mathbf{1}_3$, and $\mathbf{1}_4$ are four different types of cooking appliances, each of which is equipped with a device 30 according to the invention. In the example, the appliances $\mathbf{1}_1$, $\mathbf{1}_2$, and $\mathbf{1}_3$ are cooking hobs with four, two, and five burners, respectively, whereas the appliance $\mathbf{1}_4$ is a gas cooker with four burners. It may be assumed, for example, that for the appliance $\mathbf{1}_1$ only two burners can be controlled by the corresponding device 30, for the appliance $\mathbf{1}_2$ just one burner, for the appliance $\mathbf{1}_3$ three burners, and for the appliance $\mathbf{1}_4$ all four burners.

As may be appreciated, in this case, the configuration parameters and information necessary for the smart devices $\mathbf{100}_1$, $\mathbf{100}_2$, $\mathbf{100}_3$, and $\mathbf{100}_4$ associated to the various devices 30 that equip the appliances illustrated necessarily differ from one another, both in relation to the graphic image of the appliance (or of its area provided with burners) and in relation to the number and position of the controllable burners.

As explained previously, the smart devices can acquire from the corresponding device 30 the appliance code and/or configuration parameters, such as parameters regarding the number of controlled burners and their position, as exemplified by the signals designated by $CF_1$, $CF_2$, $CF_3$, and $CF_4$. On the basis of a unique code transmitted by the device 30 to the corresponding smart device, the latter may then download directly from a website IW, in an automatic way, the further information necessary, useful also for creating the graphic image representing the associated appliance, as exemplified by the connections denoted by $IMG_1$, $IMG_2$, $IMG_3$ and $IMG_4$.

The parameters and instructions necessary for communication between the smart devices and the devices 30 associated to the various appliances, for example the corresponding protocol, will preferably be already comprised in the dedicated program pre-installed or to be installed on the smart devices. As mentioned, on the smart device there may be pre-installed or it may be possible to install also a user and/or maintenance manual of the appliance 1 and/or of the device 30, possibly as part of the aforesaid dedicated program.

From the foregoing description the characteristics of the present invention emerge clearly, as likewise its advantages.

It is clear that numerous variations may be made by the person skilled in the art to the device and control system described by way of example, without thereby departing from the scope of the invention as defined in the ensuing claims.

The wired connections provided for the modules 40, 60 and 70 could include optical fibres for conduction of signals different from electrical supply.

The programming device 100 may be configured, as occurs in many commercially available devices such as smartphones and tablets, for communication using different communication techniques, such as Bluetooth and Wi-Fi. For instance, via Buetooth there may be set up the connection with a device 30, whereas via Wi-Fi there may be set up the Internet connection for obtaining configuration parameters of the device 30, or else the device itself can pass from a Buetooth communication to a Wi-Fi communication in the case where a higher communication rate becomes necessary.

Some characteristics described previously—such as the use of a communication module external to the structure of the gas appliance and in a remote position with respect to a corresponding control module, the use of a supply battery in a module external to the structure of the gas appliance, the use of USB connections (including mini-USB or micro-USB) between at least two modules of the device, the use of a commercial electronic device, such as a tablet or a smartphone already sold along with the dedicated program for managing the control device—must be understood in itself autonomously inventive even when it is used in combination with electronic circuits and devices that equip a gas appliance, not necessarily control circuits and control devices that perform functions of timing as described previously (for example, circuits and devices for simple remote turning-off and/or turning-on of a gas burner, circuits and devices for periodic display and/or display upon request of information of state or configuration of the gas appliance or of a user manual of the appliance in electronic form, etc.).

The invention claimed is:

1. A control device for a gas appliance that comprise at least one gas tap having a safety valve that includes an electromagnet to be supplied via a thermoelectric generator, wherein the control device comprises a circuit arrangement that includes:

a first electrical-connection element and a second electrical-connection element, configured for connection to an electromagnet and to a thermoelectric generator, respectively, of a safety valve of a gas tap;

a control arrangement, configured at least for modifying a state of an electrical connection between the first electrical-connection element and the second electrical-connection element upon expiry of a time interval;

a power-supply arrangement, comprising a power-supply circuit configured for supplying the circuit arrangement with low-voltage direct current;

wherein the control arrangement comprises:

a switching circuit, electrically connected between the first electrical-connection element and the second electrical-connection element, a control circuit, configured at least for counting time and for controlling the switching circuit, a command circuit, connected in signal communication with the control circuit at least for the purposes of setting the aforesaid time interval;

wherein the first electrical-connection element, the second electrical-connection element and the switching circuit belong to a first control module which is configured to be operatively associated to a respective gas tap;

wherein the power-supply arrangement comprise a power-supply module configured for being installed in a position remote from the first control module, and wherein the command circuit comprises a wireless-communication circuit electrically connected to the control circuit and configured for receiving and/or exchanging signals in a wireless mode with a remote electronic programming device usable at least for manual setting of the aforesaid time interval.

2. The device according to claim 1, wherein the wireless-communication circuit belongs to a second control module configured to be installed in a position remote from at least one from among the first control module, the power-supply module, a third control module of the circuit arrangement that comprises the control circuit.

3. The device according to claim 2, wherein the second control module and the third control module are configured to be installed in a position remote from one another and are electrically connected together.

4. The device according to claim 2, wherein at least one of:

the second control module and the third control module comprise a respective wiring or interconnection element for mutual electrical connection the first control module and the third control module a respective wiring or interconnection element for mutual electrical connection the second control module and the power-supply module comprise a respective wiring or interconnection element for mutual electrical connection.

5. The device according to claim 4, wherein said wiring or interconnection element comprises a fast-coupling connector.

6. The device according to claim 1, wherein at least one of:

the control circuit belongs to a third control module configured to be installed in a position remote from at least one from among the first control module, the second control module, the power-supply module;

at least one from among the wireless-communication circuit, the second control module and the power-supply module is configured to be installed outside a structure of the gas appliance.

7. The device according to claim 1, wherein the circuit arrangement comprises a battery.

8. The device according to claim 7, wherein the battery belongs to a module of the circuit arrangement that is configured to be installed outside a structure of the gas appliance.

9. The device according to claim 1, wherein the first control module or the switching circuit comprises a switching device or an electronic switch.

10. The device according to claim 9, wherein the control circuit comprises a stage for driving the switching device or the electronic switch.

11. The device according to claim 1, wherein the control circuit includes at least part of a flame-detection circuit.

12. The device according to claim 1, comprising a plurality of said first control modules, each of which is designed to be operatively associated to a respective gas tap, the switching circuit of each of the first control modules being controllable by the control circuit.

13. The device according to claim 1, wherein the remote electronic programming device is a portable device, such as a cellphone, a portable computer, a smartphone, a tablet, a PDA device, a notebook, a netbook.

14. The device according to claim 13, wherein the portable device is selected from among cellphones, portable computers, smartphones, tablets, PDA devices, notebooks and netbooks.

15. A gas appliance, comprising a control device according to claim 1, wherein the first control module and the control circuit are housed within a body of the gas appliance, and the power-supply module and the wireless-communication circuit are located outside the body of the gas appliance.

16. A system for configuring a control device according to claim 1, comprising a database from which the programming device is able to fetch respective information and/or parameters of configuration and/or operating programs.

17. A method for managing a control device according to claim 1, comprising:

setting via a remote electronic programming device at least one desired parameter, such as a time interval of gas supply to a burner controllable by the control device, and, optionally, the operation of controlling forced turning-off of a burner controllable by the control device; and displaying on a display of the remote electronic programming device one or more of the following:

an image representative of the gas appliance;

an image representative of at least one configuration and/or one state of the gas appliance;

an indication of which burner or burners of the gas appliance can be controlled by the control device;

an indication of the on or off state of a burner controllable by the control device;

an indication representative of a time that has elapsed from lighting of a burner or of a time that has elapsed from start of counting of time for a burner controllable by the control device;

an indication representative of a time that is still to elapse before programmed turning-off of a burner controllable by the control device.

18. The device according to claim 1, wherein the power-supply module comprises a respective electrical-connection element for connection to an a.c. mains.

19. A control device for a gas appliance that comprise at least one gas tap having a safety valve that includes an electromagnet to be supplied via a thermoelectric generator, wherein the control device comprises a circuit arrangement that includes:

a first electrical-connection element and a second electrical-connection element, configured for connection to an electromagnet and to a thermoelectric generator, respectively, of a safety valve of a gas tap;

a control arrangement, configured at least for modifying a state of an electrical connection between the first electrical-connection element and the second electrical-connection element upon expiry of a time interval;

a power-supply arrangement, comprising a power-supply circuit configured for supplying the circuit arrangement with low-voltage direct current;

wherein the control arrangement comprises:

a switching circuit, electrically connected between the first electrical-connection element and the second electrical-connection element;

a control circuit, designed at least for counting time and configured for controlling the switching circuit;

a command circuit, connected in signal communication with the control circuit at least for the purposes of setting the aforesaid time interval;

wherein the first electrical-connection element, the second electrical-connection element and the switching circuit belong to a first control module, which is configured to be operatively associated to a respective gas tap within a structure of the gas appliance, wherein the command circuit comprises a wireless-communication circuit, electrically connected to the control circuit and configured for receiving and/or exchanging signals in a wireless mode with a remote electronic programming device, usable at least for manual setting of the aforesaid time interval, the wireless-communication circuit belonging to a further control module of the circuit arrangement configured to be installed in a position remote from the first control module and outside the structure of the gas appliance.

20. A control device for a gas appliance that comprise at least one gas tap having a safety valve that includes an electromagnet to be supplied via a thermoelectric generator, wherein the control device comprises a circuit arrangement that includes:

a first electrical-connection element and a second electrical-connection element, configured for connection to an electromagnet and to a thermoelectric generator, respectively, of a safety valve of a gas tap;

a control arrangement, configured at least for modifying a state of an electrical connection between the first electrical-connection element and the second electrical-connection element upon expiry of a time interval;

a power-supply arrangement, comprising a power-supply circuit configured for supplying the circuit arrangement with low-voltage direct current;

wherein the control arrangement comprises:

a switching circuit, electrically connected between the first electrical-connection element and the second electrical-connection element;

a control circuit, designed at least for counting time and configured for controlling the switching circuit;

a command circuit, connected in signal communication with the control circuit at least for the purposes of setting the aforesaid time interval;

wherein the first electrical-connection element, the second electrical-connection element and the switching circuit belong to a first control module, which is configured to be operatively associated to a respective gas tap;

wherein the supply arrangement comprises a supply module and wherein at least one of:

the command circuit or the control circuit belongs to a further control module that is configured for being installed in a position remote from the first control module or from the power-supply module;

the circuit arrangement further comprises at least one battery adapted to supply one or more from among the switching circuit, the control circuit or the command circuit, the battery belonging to a functional module of the circuit arrangement that is configured to be installed in a position remote from the first control module and outside a structure of the gas appliance.

* * * * *